US006313802B1

(12) United States Patent
Petersson

(10) Patent No.: US 6,313,802 B1
(45) **Date of Patent: *Nov. 6, 2001**

(54) WAVEGUIDE LENS AND METHOD FOR MANUFACTURING THE SAME

(76) Inventor: Stig Anders Petersson, Hökmark 1585, S-930 10 Lövånger (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/436,258

(22) PCT Filed: Nov. 10, 1993

(86) PCT No.: PCT/SE93/00959

§ 371 Date: Nov. 6, 1995

§ 102(e) Date: Nov. 6, 1995

(87) PCT Pub. No.: WO94/11920

PCT Pub. Date: May 26, 1994

(30) Foreign Application Priority Data

Nov. 10, 1992 (SE) ..... 9203352

(51) Int. Cl.[7] ..... H01Q 19/06
(52) U.S. Cl. ..... 343/753
(58) Field of Search ..... 343/840, 909, 343/753, 754, 776, 786; H01Q 15/04

(56) References Cited

U.S. PATENT DOCUMENTS 2,043,347 * 6/1936 Clavier et al. ..... 343/753
2,159,937 * 5/1939 Zworykin ..... 343/753
3,189,907 * 6/1965 Van Buskirk ..... 343/753
3,247,508 * 4/1966 Bardford et al. ..... 343/753
4,536,767 * 8/1985 Rembold et al. ..... 343/753

* cited by examiner

*Primary Examiner*—Michael C. Wimer
(74) *Attorney, Agent, or Firm*—Blakely Sokoloff Taylor & Zafman

(57) ABSTRACT

In a waveguide lens for primarily circularly or linearly polarized electromagnetic radiation there is one or several rotationally symmetrical rings, arranged concentrically about a lens axis, for focusing of the incoming part of an electric magnetic wave, which has a polarization parallel to the rings, to a focus. For a still more efficient reception one or more plates arranged radially are designed so that the radial component of the electromagnetic wave is focused to the same focus. Alternatively there is instead of rings one or more spiral arms extending from the lens axis. The lens eliminates the problem of existing lens types that they only receive waves having a predetermined polarization which must be adapted to the orientation of the lens plates and the phase shifting elements. It makes for instance the reception of satellite signals more difficult, where the satellite signal is polarized in relation to the earth axis and the latitude where the satellite is located. The lens focuses all polarizations equally much which is especially favourable for circularly polarized waves but is also valid for plane polarized waves.

29 Claims, 20 Drawing Sheets

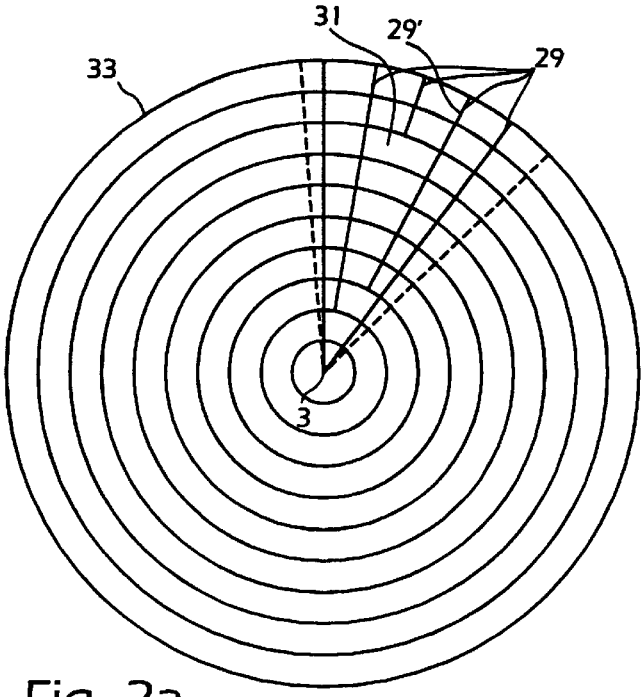
Fig. 2a
Fig. 2b
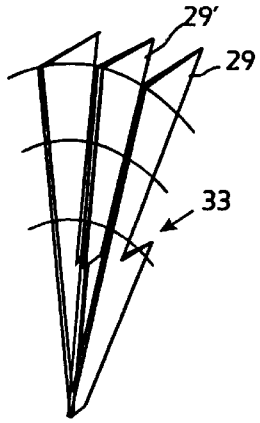
Fig. 5c
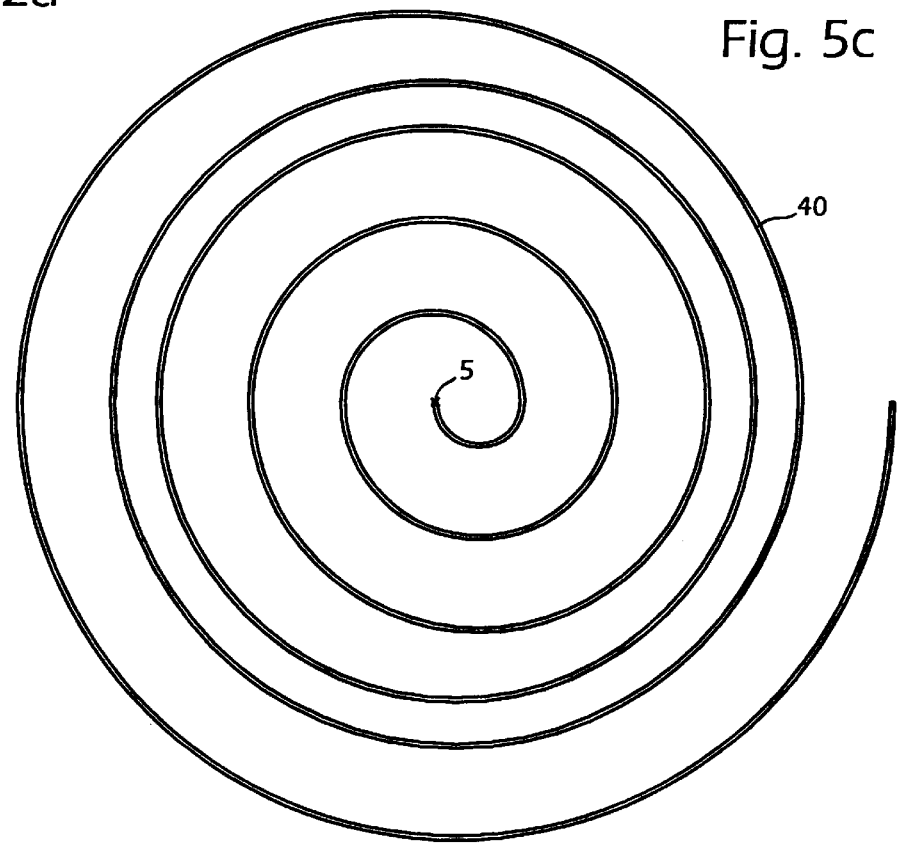

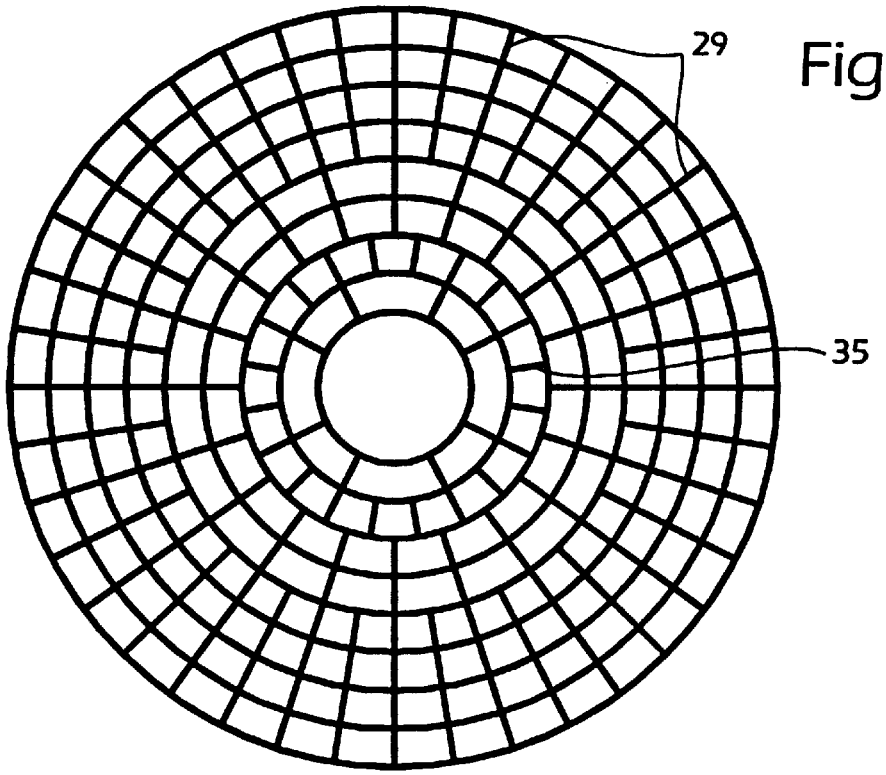
Fig. 4a
Fig. 4b
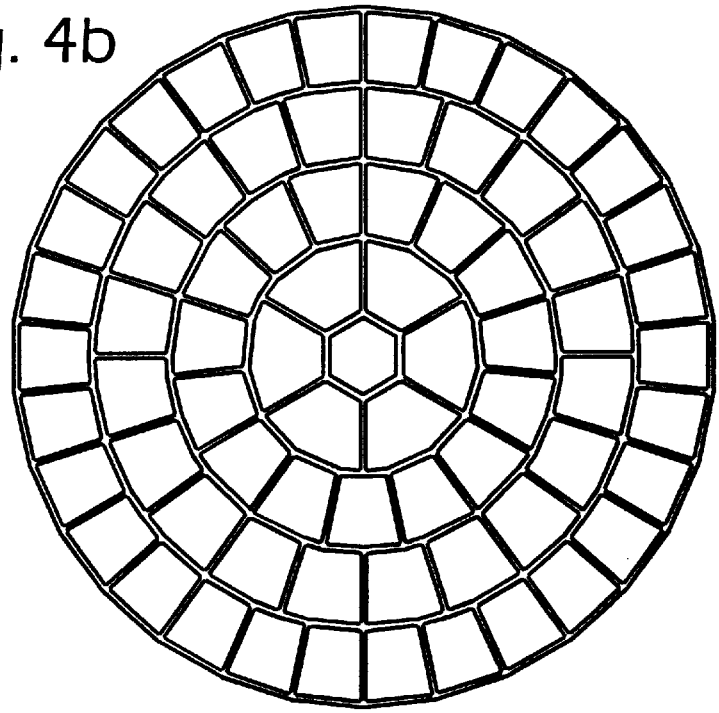

59
55
57
3
51
51
51
3
63
61
59
63

Fig. 20
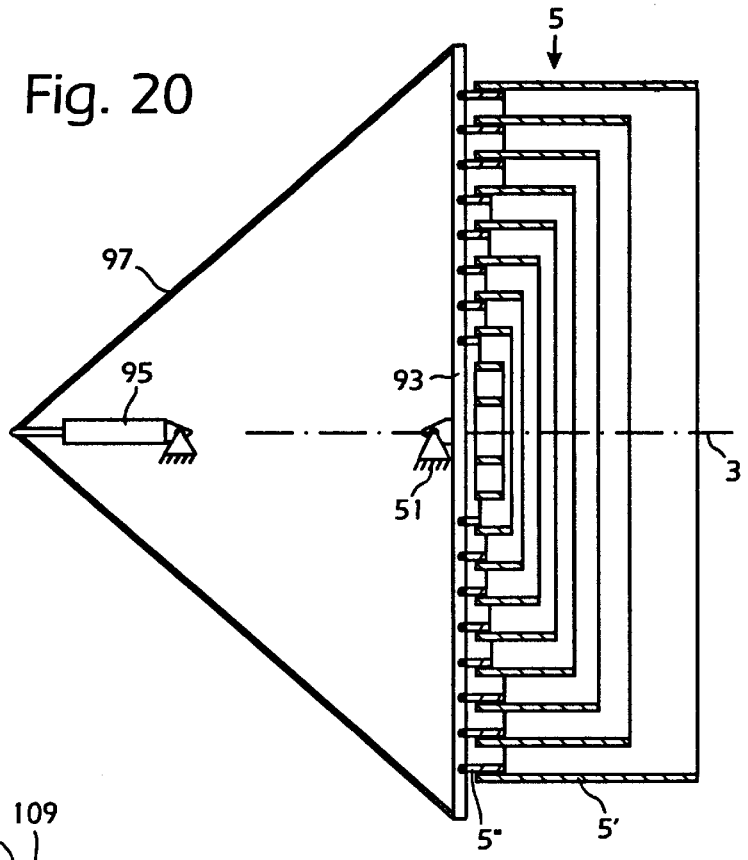
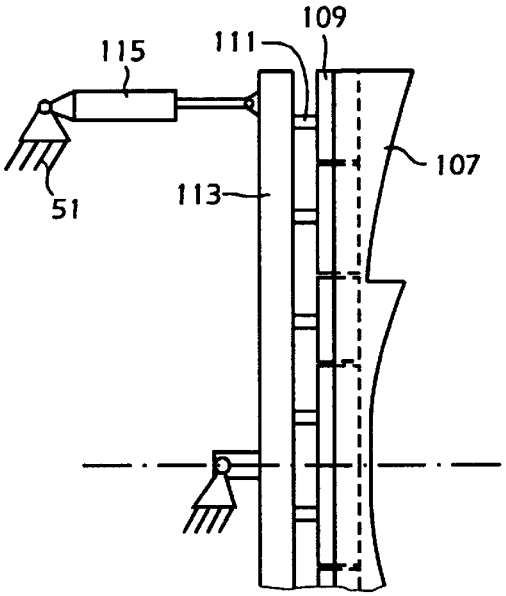
Fig. 21b
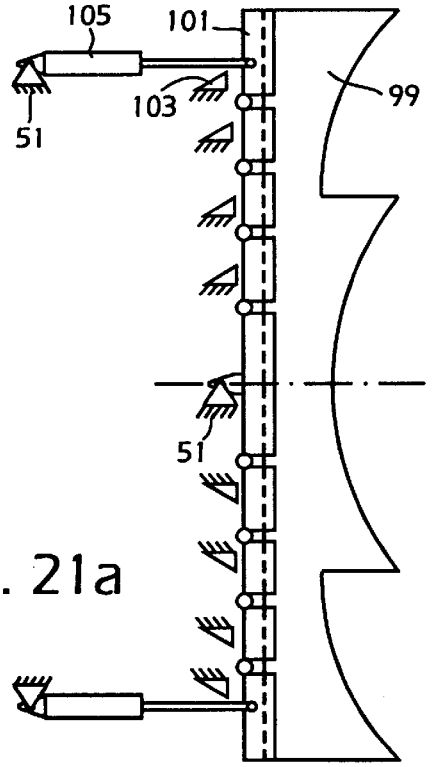
Fig. 21a c = a/b

WAVEGUIDE LENS AND METHOD FOR MANUFACTURING THE SAME

TECHNICAL FIELD

The present invention relates to a waveguide lens for principally circularly and linearly polarized electromagnetic radiation for primarily reception but also for transmission of microwaves, which for instance have wavelengths from a millimetre to several centimetres. The lens is particularly intended for reception of satellite signals in one or several wavelength bands.

BACKGROUND OF THE INVENTION

Examples of microwaves are commercial signals transmitted from satellites and signals of millimetre wavelengths. For the reception of such signals conventionally most often reflection devices are used, such as parabolic antennas, together with a receiver unit.

Waveguide lenses are used for focusing electromagnetic energy to a microwave head in the same way as the parabolic reflectors do. Waveguide lenses consist of a number of short waveguide elements having metal surfaces arranged side by side and having lengths and locations such that the front and rear surfaces of the lens form the contour of a lens, which also can be called a lens profile or a lens shape.

Waveguide lenses made of metal elements are generally very light apparatus. They may thus in many cases be preferred to lenses of dielectric materials.

There are waveguide lenses in a number of configurations in regard of the actual profile of the lens. In a variant, the zone divided or zoned lens, the composition of the waveguides is such that for instance one surface is flat and the other one is rotationally symmetric about the axis of the lens and has an ellipsoidic profile for forming a concave lens. A downstepping of the lens thickness in circular steps of one wavelength may exist for reducing the thickness or depth of the lens at the periphery thereof.

In another embodiment, lenses having a constant thickness, the sizes of the interspaces between parallel metal plates vary, which form the waveguide channels. Such lenses have up to now only been made for a single polarization plane.

In a third case the lens consists of phase shifters in each waveguide element in order to produce the correct focusing of an incident flat electromagnetic wave. These phase shifters cooperate in various structures to make the lens more or less independent of frequency.

The principal advantage of a waveguide lens to a parabolic reflector is that a feeding horn/receiver horn not necessarily has to be arranged and shadow the plane incident wave. Another advantage is that the lens is transparent and open in order to let the wind pass. In particular for large parabolic antennas the problem exists that they at the same time form a large surface exposed to the wind, which is eliminated with an open waveguide lens.

Another advantage of the waveguide lens is the better radiation lobe characteristics thereof and that also an obliquely incident wave front has a distinct focus.

The disadvantage of many of the existing lens types is that they only receive waves having a predetermined polarization, which has to be adapted to the orientation of the lens plates and the phase shifting elements. It makes the reception of satellite signals more difficult, in the case where the satellite signal is polarized in relation to the earth axis, which only agrees with the earth plane in places at the same latitude as the satellite. Everywhere else the polarization of the satellite has a slope in relation to the receiver.

Further, each plate in existing lenses have a very complicated curved profile shape, which in addition is different for plates located at different distances from the lens axis. The positioning of the plates is in addition very critical and requires stable plates, this causing that such a lens will be heavy.

Waveguide lenses have, as has been mentioned above, been proposed having various geometries and structures. They may be constructed of parallel conducting plates having varying profile heights, so that channels of different lengths or depths are formed between the plates, see U.S. Pat. Nos. 2,736,894, 2,785,397, 4,194,209, FR-A1 2 538 959. The channels can also have different widths or be given differently sized impedances in various ways, see for instance U.S. Pat. Nos. 4,321,604, 2,841,793, SU-A1 1589342. The exterior contour of the lenses as generally viewed can be rotationally symmetric having steps or steppings occurring when passing outwards from the geometric axis of the lens, see for instance the mentioned U.S. Pat. No. 2,736,894. Also, entirely rotationally symmetric lenses of dielectric material have been suggested, see U.S. Pat. Nos. 2,705,753, 4,804,970, GB-A 2 155 699. However, up to now the lenses have had a complex construction and have not led to a wide commercial use.

DESCRIPTION OF THE INVENTION

With the invention a lens antenna is provided having a structure which primarily is practically applicable.

The purpose of the invention is to provide a lens antenna eliminating practical obstacles and disadvantages of existing lenses.

The purpose of this invention is to eliminate or reduce the problem of the action of the wind forces which exists for conventional parabolic antennas.

The purpose is further to provide a lens antenna having a structure which has such a simple structure that it is suited for mass manufacture and thus to provide a competitive alternative to the paraboloid technique of today.

The purpose is further to provide a lens having less losses and a better directivity than prior lens antennas of standard type in order to thereby reduce the size of the lens.

The purpose is further to provide a lens, for which a good depiction is obtained of a radiation source having an oblique incidence to the surface of the lens.

The purpose is also to provide a method to reduce the noise level of a satellite signal receiving system by providing an antenna system having better characteristics than those of parabolic systems.

Another purpose is also to give the user of receiving equipment a possibility of theft prevention compared to an unprotected parabolic antenna for the reception of satellite signals.

Another purpose is further to give the user of receiver equipment an aesthetically better shaped satellite antenna compared to the present parabolic antennas.

The purposes mentioned above are accomplished by the invention, the more detailed characteristics and features of which are set out in the appended claims.

The present lens antenna eliminates the problem of varying slopes of the polarization of the signal to be received, by focusing all polarizations equally much. It is in particular favourable for circularly polarized waves but is also true for linearly polarized waves. It is never required to turn the lens about the axis thereof for a tuning to different polarization directions, what eliminates a mechanically unwieldy mounting or suspension, especially for large antennas.

The present invention is also significantly more simple in the structure thereof than existing lenses for several polarization directions.

Thus in the lens waveguiding channels are formed by means of a structure having radial plates and rings or bands having a cylindrical or approximately cylindrical, circular extension. The rings or bands are thus essentially rotationally symmetric about a lens axis. The plates extending in radial directions arranged symmetrically about the lens axis enhance further the efficiency of the lens.

By the symmetric structure the performance characteristics of the lens are the same system for the reception of circularly polarized signals and signals having an unknown polarization. A lens having both circular rings and radial plates gives a perfect image of a radiation source also for oblique incidence to the surface of the lens.

The structure is, at least in some embodiments, much simpler than lens antennas presented up to now, for instance when the circular ring elements are made of metal bands or plastic bands having a uniform thickness. The elements in the radial directions will, due to symmetry, appear in a limited number of structures which are repeated in a predetermined number within a full turn.

In one embodiment, where the rings or bands are shaped as one or several spiral arms, the structure is still simple, having bands of an increasing width when passing outwards from the axis of the lens, which bands in addition can be rolled up and be varied for a wider frequency range. The elements located in the radial directions have a simple shape and they must only be designed in the same number of sets as the number of spiral bands.

Putting it into slightly different words, there is one or several essentially rotationally symmetric rings, arranged concentrically about a lens axis, for refraction of each local part of an incoming electric wave, which locally has a polarization parallel to the rings, to or from a focus. For a still more efficient reception or transmission two or more plates extending in radial directions and located in axial planes through the lens axis are designed in such a way, that the local component of the electromagnetic wave in the radial direction is focused to the same focus. Alternatively the rings have the shape of one or more spirals starting at the lens axis.

The lens is intended to be used in the first place in a receiving system but it can also be used in a transmitting system according to the principle of the inversion of ray paths.

DESCRIPTION OF THE DRAWINGS

The invention will be described in more detail with reference to nonrestricting embodiments and with reference to the accompanying FIGS. 1*a* –31*b,* where FIG. 2*a* shows an lens antenna in another embodiment and in a plan view as seen from the irradiated side of the antenna, FIG. 2*b* shows a perspective view of three radial plates for the lens antenna of FIG. 2*a,*

FIG. 4*a* shows a view in an axial direction of another embodiment, where the radial plates are divided in sections, FIG. 4*b* shows a view in an axial direction of an embodiment with rings having polygon shapes, FIG. 5*a* schematically shows a lens antenna where the rings are made in spiral shapes.

FIG. 20 shows a view, partly in section, of a lens antenna, where the profile height of the circular rings can be varied, FIG. 21*a* shows a lens antenna where the heights of flat plates can be varied, FIG. 21*b* shows a section of a lens antenna where the profile height of radial plates can be varied.

DESCRIPTION OF PREFERRED EMBODIMENTS

A lens antenna can be seen as a receiving system or a transmitting system. In the following of this description the structure of a receiving system will be explained but it must be emphasized that the lens as well can be used for transmission.

Figure 1A:
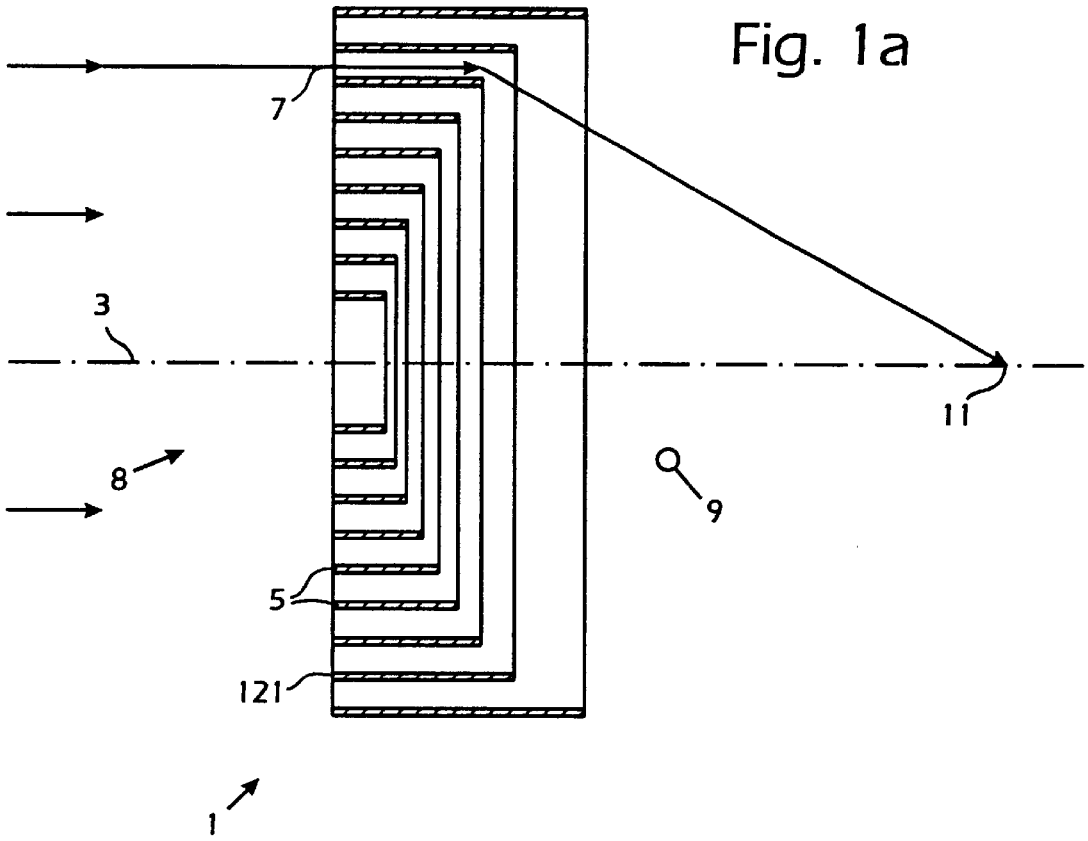
FIG. 1*a* shows an axial section of an embodiment of a lens antenna composed of concentric rings.

The lens is generally referenced 1 and in FIG. 1*a* an embodiment of a lens antenna is illustrated comprising a number of, for instance as is shown here, nine, rings 5 concentric to an axis 3 and made of a thin conducting material such as Al or Cu plate having a thickness of 0.1–0.2 mm. The thickness of the rings 5 is in the Figure widely exaggerated for the sake of easy drawing. Each ring 5 has the shape of the envelope surface of a straight circular cylinder. The rings 5 have different heights and are located, so that one edge thereof, in FIG. 1*a* seen as the left edge, is located in the same plane perpendicular to the lens axis 3. The envelope of the other edges of the rings 5 form an curved surface or segment of a sphere, which then naturally is rotationally symmetric about the lens axis 3. The radial distances between neighbouring ring surfaces are constant and has approximately the same size for all neighbouring pairs of rings, i.e. the differences of the radii of neighbouring ring surfaces 4 are substantially equal in the whole lens 1.

The rings 5 can be mounted on a frame or support (not shown) of a material having a relative dielectric constant close to 1 such as on a plate of foamed plastics.

The operation of the lens illustrated in FIG. 1*a* will now be explained. A plane electromagnetic wave is supposed to be incident to and encounter one side, as viewed in FIG. 1*a* the left side, which thus is the irradiated side 8 of the lens 1, and passes through the annular channels 7 between the rings 5. The channels 7 are of course like the rings 5 rotationally symmetric about the lens axis. Each part of the wave or the signal which is present in a small considered part of a channel 7 and which has a polarization parallel to the surface of the rings 4 within this part, will obtain a phase velocity between the rotationally symmetric rings 4. With a suitable length of the channels 7, which can be obtained from state-of-the-art calculations for lenses of this type and thus with suitable heights of the rings 5, a wave front is obtained in the exit of the wave from the lens on the shadow side 9 thereof, the wave front being refracted to a common focus 11.

Figure 1B:
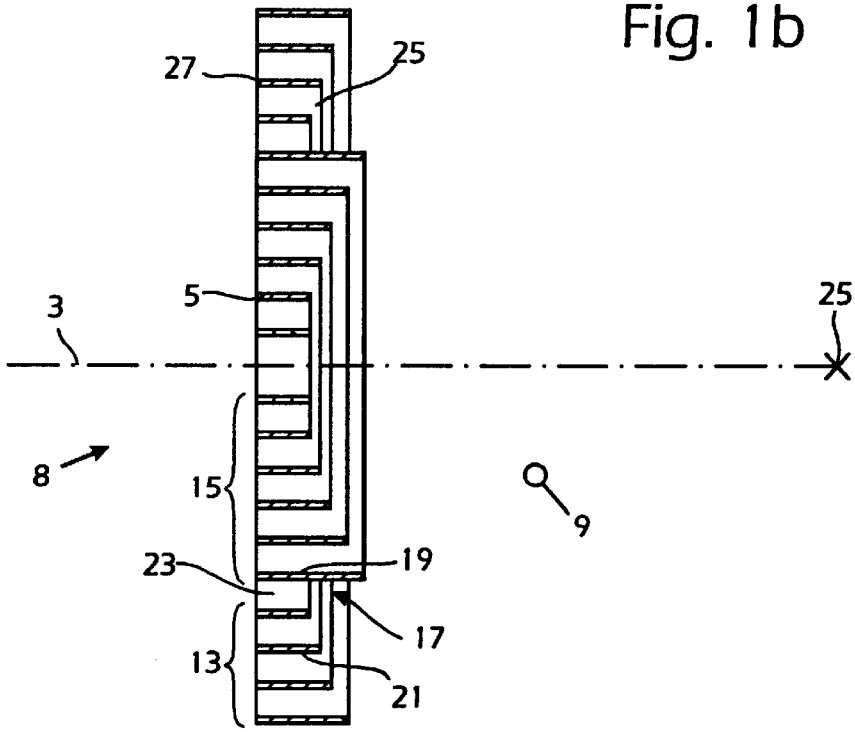
FIG. 1*b* shows an axial section of an embodiment of a lens antenna having steps in the lens profile.

A lens antenna 1 constructed as is illustrated in FIG. 1*a* will have a relatively large axial length and it may therefore be constructed according to FIG. 1*b*. Here the envelope of the shadow side 9 of the lens for an outer group 13 of the rings 5, for instance such as is illustrated there consisting of the four rings located outmost, is a ring segment of a curved surface having its center on the lens axis 3 and the envelope of the inner rings 15 is a segment of another curved surface, such that a step 17 is formed at the transition between the group 15 of inner rings and the group 13 of outer rings. The step 17 has the size of one wavelength of the incident wave according to the known stepping technique for lens antennas. Several steps of this type can be arranged in the corresponding way to reduce the axial length of the lens antenna. In other words, the height of the step 17 is thus equal to the difference of the height of the outer ring (19) in one group (15) and the height of the inner ring (21) in the group (13) located at the outside thereof and this difference is for instance of the magnitude of order of the wavelength of the incident electromagnetic wave which is valid inside the channel between the rings.

However, the heights of the rings S in the neighbourhood of these steps 17 will have a combined effect on the electromagnetic wave. Consider first the channel or space 23 having the shape of a rectangular cylinder ring with an outer curved surface equal to the lowest ring 21 at a step 17 and with an inner curved surface being a part of the highest ring 19 at the step. In this space 23 the usual refractory index of the channels 7 is valid. In the second place also spaces are formed having the shape of rectangular cylinder rings such as is illustrated at 25 between rings, which are located at two or more ring distances from each other and do not pass through any intermediate ring surface 5. In these spaces such as 25 other refractory indices will be valid. This effect arises due to the fact that the intermediate ring 19, i.e. the outermost ring in an inner group 15 of rings 5, is higher or longer than not only the next ring 21 located next to it on the outer side thereof but also is longer than several rings located at the outside thereof such as 27.

In this embodiment having rotationally symmetric rings 5 it is possible to compensate for this addition to the refraction of the electromagnetic wave, what up to now has never been possible in existing structures. The compensation comprises an adjustment of, for instance the height of the innermost ring 21 in an outer group 13 in relation to the known lens equation, so that this ring 21 provides a compensation of the phase velocity of the electromagnetic wave also between the outermost ring 19 in an inner group 15 and the ring 27 next to the innermost ring in a next outer group 13. For instance, the high ring at a step will give an additional amount causing, that the next outer low ring, i.e. the innermost ring in the next outer group, in typical cases can be of the magnitude of order a few millimetres lower. The effect can also be compensated for by making a regrouping radially of the innermost rings in a group, i.e. a change of the radii thereof.

The structure comprising rotationally symmetric rings 5 offers further the possibility of varying the distance of two neighbouring rings 5 when passing outwards in the radial direction, see for instance the lenses in FIG. 8 (consider for instance the distances between the outermost rings) and FIG. 11*a* which are described below. Thereby the lens can be constructed with different refractive indices, which are rotationally symmetric about the optical axis 11, what for example gives the following four advantages:

1. The refractive index can be chosen lower, i.e. the rings be located closer to each other, which gives shorter channels, so that the heights of the rings and thus the lens thickness will not be too large. This can be made close to a step 17, so that the rings here will be lower. This gives savings as regards material of the rings, in particular within the areas where the highest rings are located.
2. The step 17 can, for instance for lenses having a minimal thickness—i.e. a thickness close to zero mm—at the lens axis, be positioned in cooperation with the Fresnel zones for the frequency which is to be focused. Where a Fresnel zone is to be covered, for instance a band or ring having the corresponding thickness can be arranged. It will make the lens more efficient for the frequencies which deviate from the design frequency and can give still more constructional advantages of the type mentioned in the discussion of item 1. For instance a lens having a design focus distance of 1700 mm for the wavelength 26.8 mm has a step at the distance 600 mm from the optical axis, where there is also a covered Fresnel zone for the corresponding waves with the same design focus. It is here suitable to introduce a thicker circular ring for the mechanic stability but also to cover the Fresnel zone. See for instance the ring 205 in the lens of FIG. 11*a* described below.
3. In the parts of the lens 1, where the edge heights of the rings 5 and their distance from each other are critical as viewed from a refraction standpoint, i.e. where a relatively small distance error in the construction influences critically the focusing, a balancing can be made between the interspaces of the rotationally symmetric rings 5 and the material consumption and the accuracy of the plate position which is required for the distance. For instance, rings which are located at radial distances from the lens axis 3, where relatively long channels 7 are required for a refraction to the focus 11, can be made thicker and more rigid in order to be able to maintain a more exact distance from each other. Further a shielding or displacement of rotationally symmetric zones about the lens axis 3, which are critical for refraction to the focus 11, can be made by selecting thicker bands. See for instance the ring 205 having a channel at the inner side thereof, which has a long axial extension, in the lens of FIG. 11*a* described below.
4. In connection with introducing a step 17 in a waveguide lens 1 the transmission lobe or reception lobe is influenced by the fact that the new step is located adjacent to a long channel. If the step is chosen on the exit side (shadow side 9) of the lens 1, a radiation lobe is obtained, which has not its maxima directed to the focus, and if the step 17 is chosen to be located on the irradiated side, the optimal reception lobe is obtained obliquely to or slanting in relation to the direction of irradiation, both in the E- and H- directions.

Figure 27A:
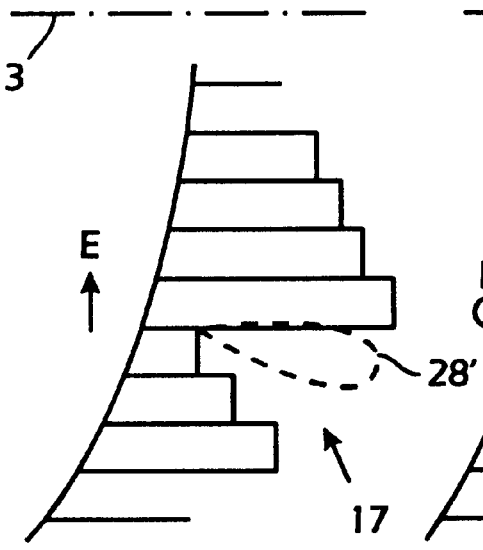
FIGS. 27*a* and 27*b* show the radiation pattern close to a step according to the present state of the art.
Figure 27B:
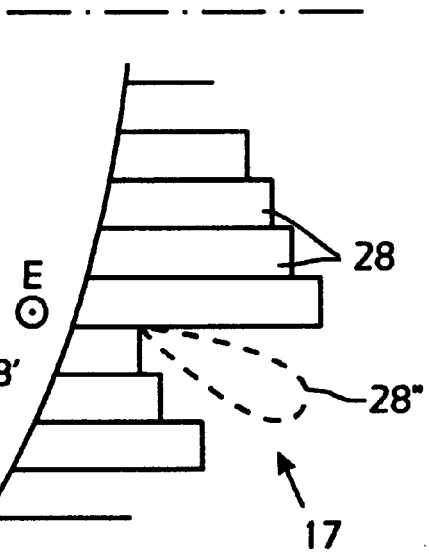

In FIGS. 27*a* and 27*b* it is thus shown, schematically and viewed from the side, channels 28 located at a profile step 17, which is located on the irradiated side, and how the step influences the radiation components in the E-direction (the dotted line 28' in FIG. 27*a*) and in the H-direction (the dotted line 28" in FIG. 27*b*). They are distributed in size in different directions in the neighbourhood of the step. The edge of the step is located symmetrically in the direction of the lens axis 3 and the drawn lobes 28', 28" can also be seen as radiation lobes with the radiation source at a focus located to the left in the Figures or, as has been mentioned, as a reception lobe with the irradiated side to the right in the Figures and the focus on the left side. In both cases the ideal is that the lobe 28', 28" has its maximum directed in parallel to the lens axis 3, i.e. in the direction in which the radiation or the reception is intended to be directed, but due to surface effects caused by the radially exterior surface of the step, the lobe will have another direction.

Figure 11A:
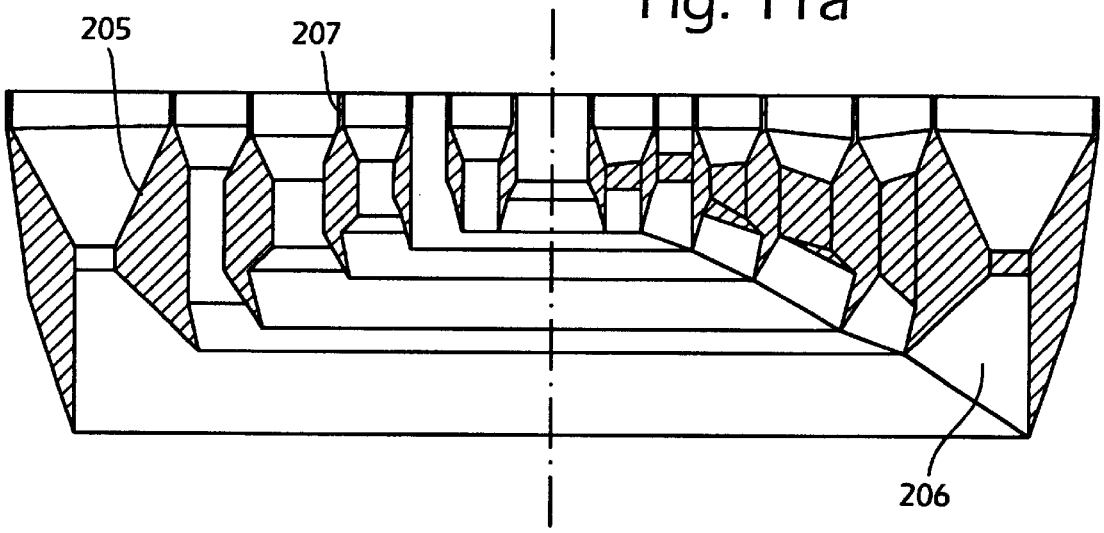
FIG. 11*a* shows an axial section of a rotationally symmetric lens having bevelled edges and channels of horn type, radial and circular plates/rings.

This can be eliminated with a lens constructed of circular bands, by, for instance in connection with the steppings of the lens making a band, such that the marginal portions thereof have a slant, for instance by making a relatively thick band having a tapering outer marginal portion (205 in FIG. 11*a*). The direction of the lobe in relation to the lens axis, where the E field is in parallel to the circular rings, is according to known theoretical calculations a function $\alpha=2\cdot\sin^2 U+2j\cdot\sin U\cdot\cos U$, where U is a characteristic dimension of the channel. If the wall of the plate has a corresponding slant, a lobe is obtained which is directed towards the source on the irradiated side and a slope on the shadow side can be adjusted, so that the maximum of the lobe will be directed to the focus. See the outermost channel outside the ring element 205 in FIG. 11*a*.

Such constructive choices are more difficult to introduce for lenses, where the channels are constructed of straight or curved, parallel bands, or of tubes.

Figure 3:
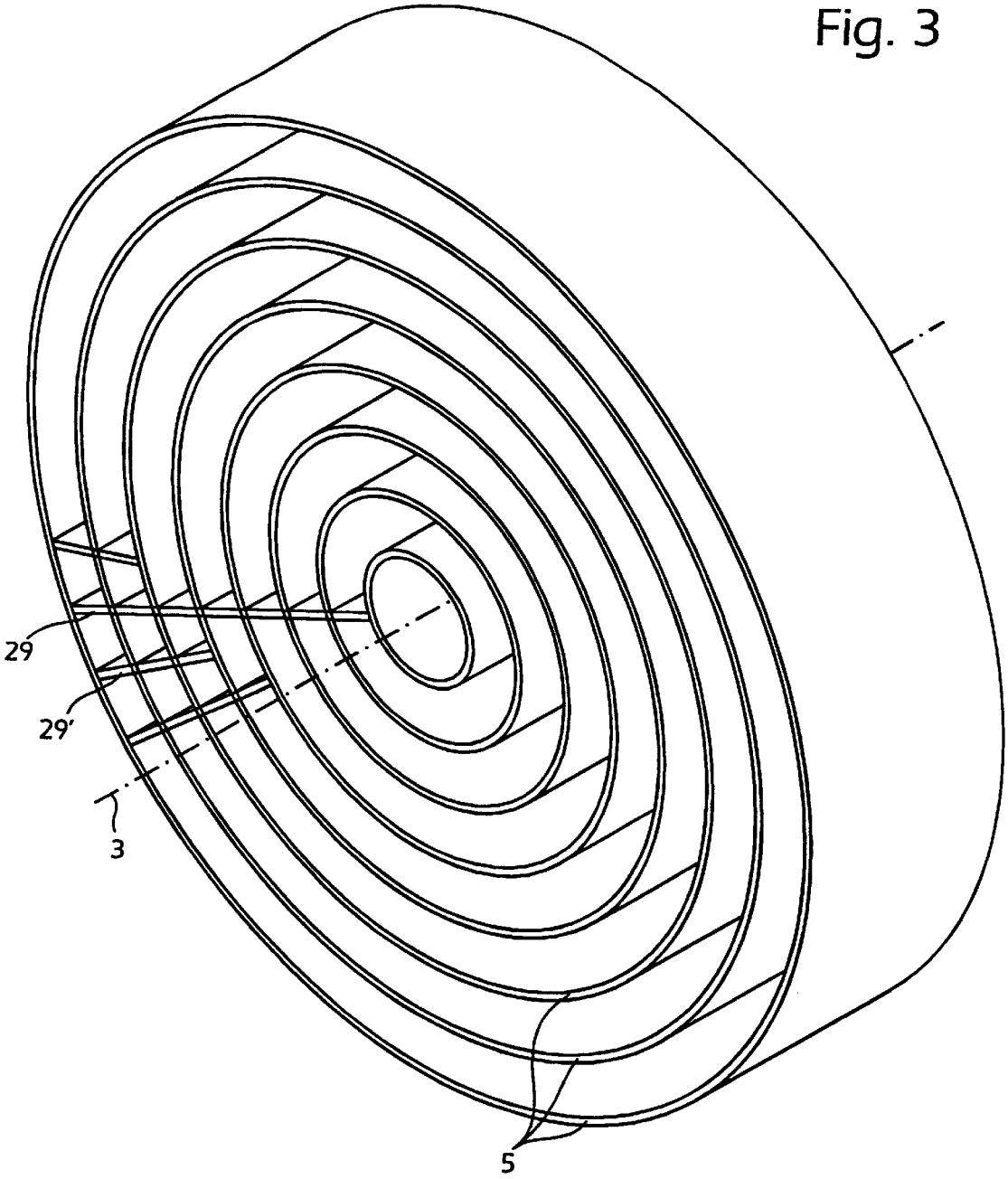
FIG. 3 shows a perspective view of the lens antenna of FIG. 2*a,*

The embodiments of lenses 1 in FIGS. 1*a* and 1*b* can, as is illustrated in FIGS. 2*a* and 3, be supplemented by radially extending plates 29, principally made of the sane materials as the rings 5. The radial plates are thus located perpendicularly to the walls of the channels 7. In FIGS. 2*a* and 3 only a small number of these plates 29 are shown, which are evenly distributed over the full turn about the lens axis 3. By these radial plates 29 smaller channels 31 are formed, which refract the component of the electromagnetic wave in a radial direction.

Since these plates 29 are not parallel but form an angle to each other, their profile heights, i. e. the heights of points at their profiled edge in relation to the other straight edge, which extends substantially in a radial direction, will be dependent of both the distance from the lens axis 3 and the interdistance between the individual radial plates 29, and generally the profile heights will increase in radial directions outwards from the lens axis 3, where it is also considered, that the mutual distance of the radial plates 3 increases with the radius or the distance from the lens axis 3.

The plates 29 extend principally perpendicularly to the plane of the irradiated surface, in planes through the lens axis 3. They are dimensioned and given heights in the direction of the lens axis considering the lens formula so that a refraction to the focus 11 is obtained. When the radial plates 29 are organized in a symmetrical way, evenly distributed about the lens axis 3, and also the rings 5 are located at a constant interspace from each other, the distances between points on neighbouring plates will decrease at positions more close to the lens axis 3. The refraction index in the channels existing between the rings 5 and the plates 29 will then be reduced also at positions more close to the lens axis, resulting in that the edge heights of the radial plates will be lower than the edge heights of the rings which they intersect. In the corresponding way a radial plate 29 will have a larger edge height than the rings which it will pass at positions further away from the lens axis.

When the distance between two neighbouring radial plates 29 when passing in the direction outwards from the lens axis 3, has increased to more than the whole design wavelength, a new radial plate 29' will start and the profile height of the new radial plate 29'and the longer radial plates 29 are here changed by a step 33. This step method can be combined with the convention described above to make the lens in steps, where thus the thickness of the plates 29, 29' is stepped down by one wavelength whenever possible.

In this lens of FIGS. 2*a,* 2*b* and 3 the shape of the step 33 is not related thereto but is only the result of the fact that the introduction of a new short radial plate 29' between two already positioned plates gives more narrow channels, thus a lower refractive index and thus influences the profile heights of the plates.

The radial plates 29 can also be arranged as illustrated in FIG. 4*a*. Here there are no radial plates extending from positions near the lens axis to its periphery, but the plates are shorter being displaced circumferentially. They will thereby be divided in radial sections and here there is for instance radial plates such as 35 extending only between two neighbouring rings in the lens antenna.

The radial plates 29, 29', 35 in the embodiments according to FIGS. 2*a*–4 can also serve as distance materials between the circular rings 5 and contribute by the multitude thereof and the extension radially to position, in a most exact way, the circular plates 5 at the intended distance from the lens axis 3. In this case it is also possible to suppress the carrier mentioned above (not shown) by means of a suitable splicing method.

It can be observed that the radial plates can be made with an approximative adaption to the lens equation by the fact that the edges at the profiled edge of the plates are constituted by straight line segments between two or several neighbouring circular rings 5 as well as that the circular rings 5 themselves can be approximated by flat surface segments between two or several neighbouring radial plates. The lens would thereby be given a shape more or less similar to a polygon and a possible embodiment is schematically illustrated in FIG. 4*b* in a view along the direction of the lens axis.

Figure 5A:
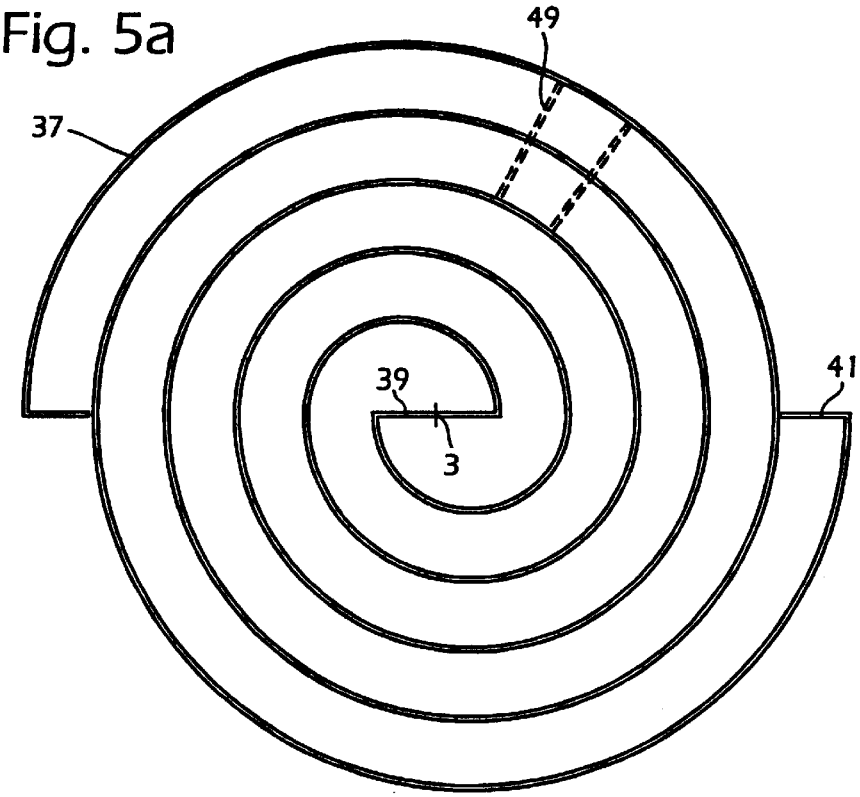
FIG. 5*b* shows the profile of a plate for the lens antenna of FIG. 5*a,*
FIG. 5*c* schematically shows a lens antenna with a spiral arm having a constant width.

The circular rings are in another embodiment only approximately circular, such as in the embodiment according to FIG. 5*a,* having two bands 37 of spiral shape made of a conducting thin material, extending in a spiral of a small pitch out from an area adjacent to the lens axis. The spiral bands 37 extend approximately perpendicularly from a flat band section 39, the center of which is located at the lens axis 3, and they are terminated by flat portions 41, which are folded inwards perpendicularly and extend in radial directions and which with their free ends connect to the spiral arm located next to it and inner side thereof. The profile heights of the bands 37, i.e. the height of the profiled edge thereof from the other edge which is a straight line, is tuned to the radial distance between neighbouring portions of the spiral arms, so that the height of the band in the radiation direction will increase outwards from the attachment points of the band arms at the center of the lens according to the lens formula as above. The lens illustrated in FIG. 5*a* has two spiral bands 39 of a constant pitch, such that the radial distance between neighbouring portions of the bands is constant all over the lens.

If the radial distance between the spiral turns instead is varied when passing outwards from the lens center, it is possible to obtain a lens having a constant thickness, so that the profile heights of the spiral bands 39 are constant, i.e. the bands 39 have a uniform width all over their length. By combining a varying distance between the turns and the profile height of the spiral band according to known calculation methods for instance an embodiment is obtained, where the width or profile height of the spiral band is constant within one interval and increases linearly within another interval of the radial extension of the lens. Such embodiments give a simple material saving design of the spiral bands 39. In FIG. 5*c* is schematically shown, as viewed in the direction of the lens axis, an embodiment having a single spiral arm 40 extending out from the lens axis 3 and having a constant thickness and width.

The lens according to 5*a* which has no radial plates can be constructed of a sufficiently thin springy and elastic material in order to be able to be rolled up or rolled out from a rolled-up position.

Figure 5B:
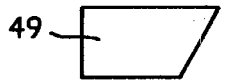

However, also the lens having bands 37 extending spirally can be provided with plates 49 extending approximately radially, some of which being indicated in dotted lines in FIG. 5*a*. A typical profile of such a plate 49 is shown in FIG. 5*b*. The radial plates 49 here act as waveguides and in the case where the spiral arms are not variable also as a distance material between the two bands 37. The radial plates 49 will in this case, where they only extend between neighbouring portions of the spiral arms 37, due to their short, straight edges have an uncomplicated profile. Such an arrangement comprising short radial plates 49 can also be applied to the lens formed by circular plates 5.

Figure 6A:
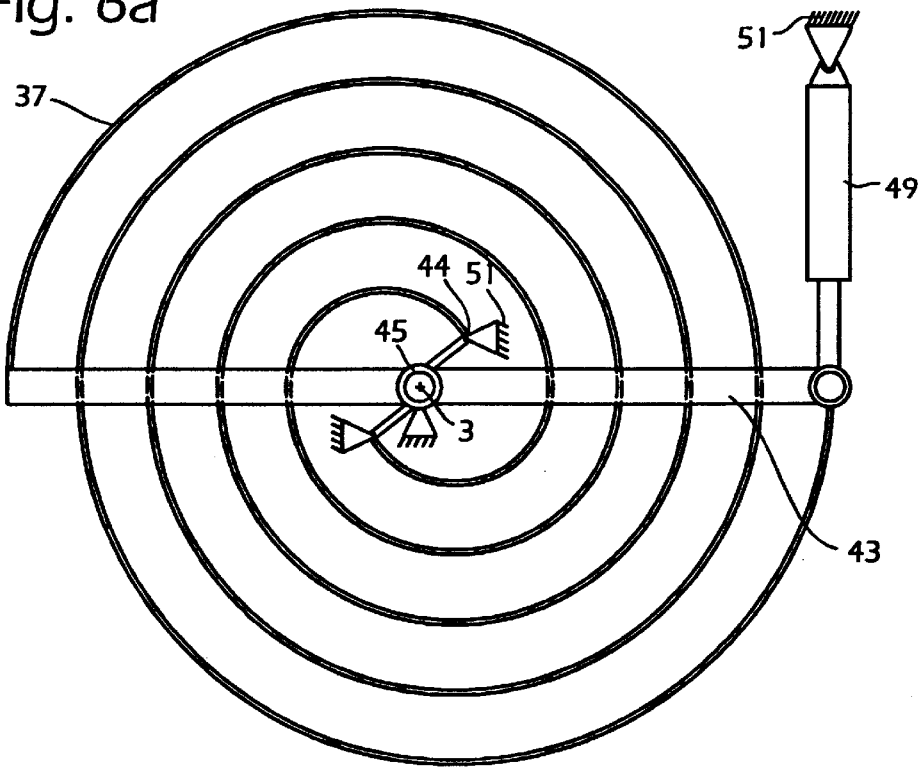
FIG. 6*a* shows a view in an axial direction of a lens antenna having spiral arms with a variable pitch.

In the embodiment according to FIG. 6*a* it is possible to control the rolling-out. The embodiment according to FIG. 6*a* agrees with the embodiment of FIG. 5*a* with the exception that the outer ends of the bands 37 are attached to a retaining rod 43 extending along a diameter. The retainer rod 43 is hinged at the lens axis 3 by means of a bearing 45. The inner ends 44 of the bands 37 are instead fixed in space, such as being attached to a frame indicated at 51. By turning the retainer rod 43 about the center bearing 45, for instance by the influence of a fluid cylinder 47, having one end attached to the frame 51 and another end hinged to the retainer rod 43 at a point located at a distance from the center bearing 45, the pitch of the spiral bands 37 is varied. Hereby it will be possible to adjust the lens to a special frequency band, since the focus 11 of the lens for, for instance a lower frequency, is the same as that for a higher frequency, if the radial distance between the approximately circular rings (the spiral bands 37) is adjusted proportionally to the wavelength, provided that the thickness of the spiral bands 37 in the radial directions is a negligible fraction of the wavelength, for instance a hundredth, and the two wavelengths do not differ more than for instance 50% from each other, or if the radial thickness constitutes a large part of the wavelength and the difference of the wavelengths or the frequency variation is 10% at most.

Figure 6B:
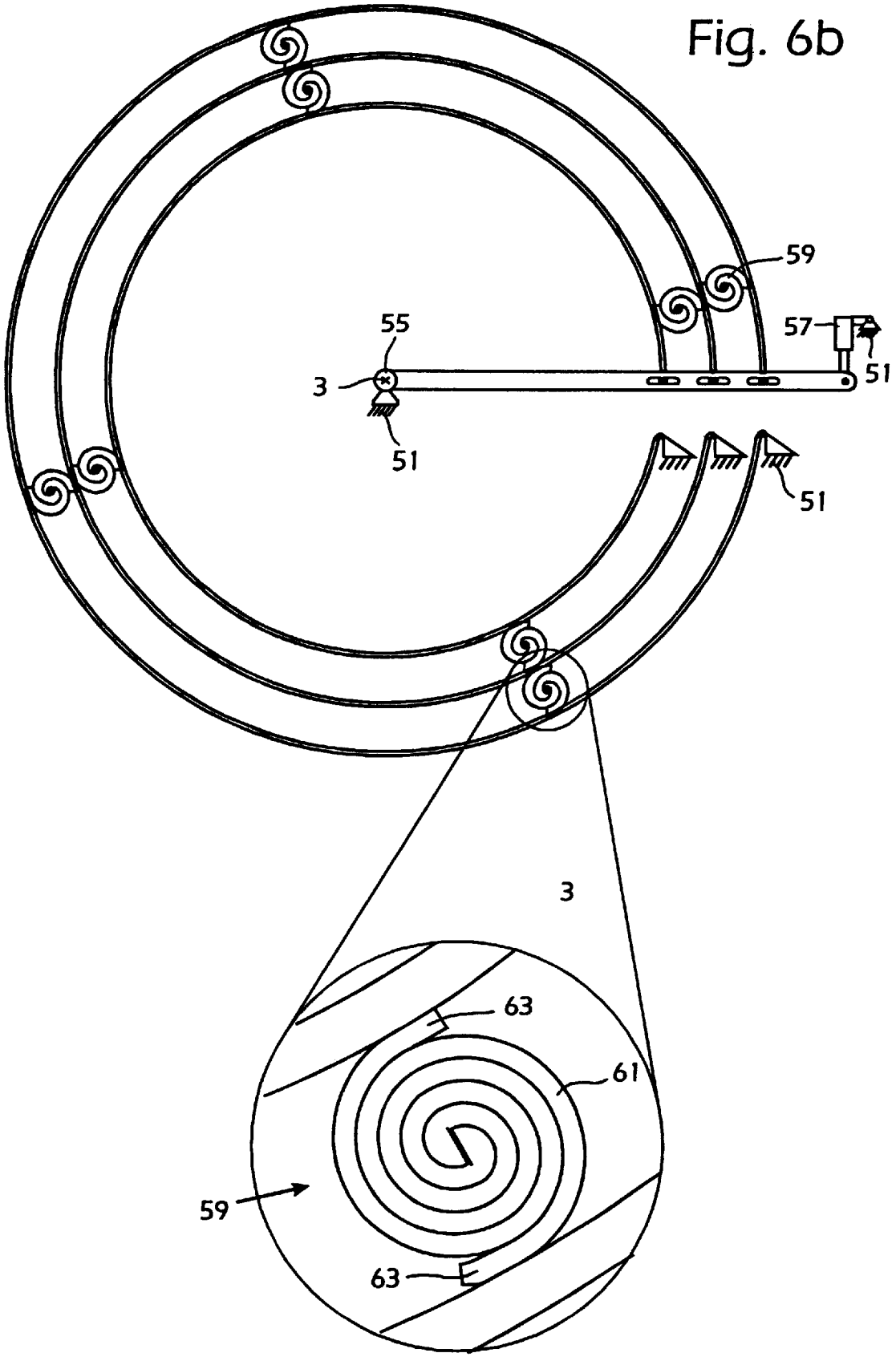
FIG. 6*b* shows a view in an axial direction of a lens antenna having circular, variable rings.

Also the circular rotationally symmetric rings 5 can be made with a variable radial distance according to FIG. 6*b*. The circular rings consist of springy thin material, for instance hard/semi-hard copper plate, and they are cut off or broken so that two ends are formed. One end of each ring 5 is attached to a frame, carrier or support, not shown but indicated at 51, and the other end at different points on a retainer arm 53. The retainer ann 53 is hinged to a fixed position in space by means of a bearing 55, mounted on the support 51 for turning or swinging about the lens axis 3. When the retainer rod 53 is turned in one direction, clockwise according to FIG. 6*b,* the radius will decrease for each circular ring 5 and the space between the rings will thus decrease. The turning or swinging of the retainer rod can be produced by the influence of a fluid driven piston and cylinder assembly 57, one end of which is through a hinge connected to a point on the retainer rod 53 at a distance from the center bearing 55 and the other end being mounted fixed in space, such as being attached to the frame 51.

Distance material between the circular rings can be introduced for the centering and positioning of the circular variable rings 5, for instance by elastic distance material (not shown) or, as is indicated in FIG. 6*b,* by means of rolls 59. They are made of a band 61, which has two arms rolled in a spiral shape and it is transparent to microwaves and may thus be made of a suitable dielectric material and both band ends 63 of which are attached to different, neighbouring circular rings 5. When the distance between the circular rings 5 is varied, for instance for a reduced distance between the rings, a portion of the bands 61 is rolled out and with a suitably adapted thickness of the band material 61 in the rolls 59 the diameter of the roll 59, which is reduced hereby, will correspond to the reduced distance between the rings 5. It will provide a relatively accurate positioning of the bands 5, when the ring space is varied within a certain distance range. If the rolls 59 contain a sufficiently long band 61, which for instance at its inner part or central part is thin within one roll-out range after the position where the distance producing effect has come out of interest, this lens having circular rings 5 can be made entirely collapsible.

Figure 17:
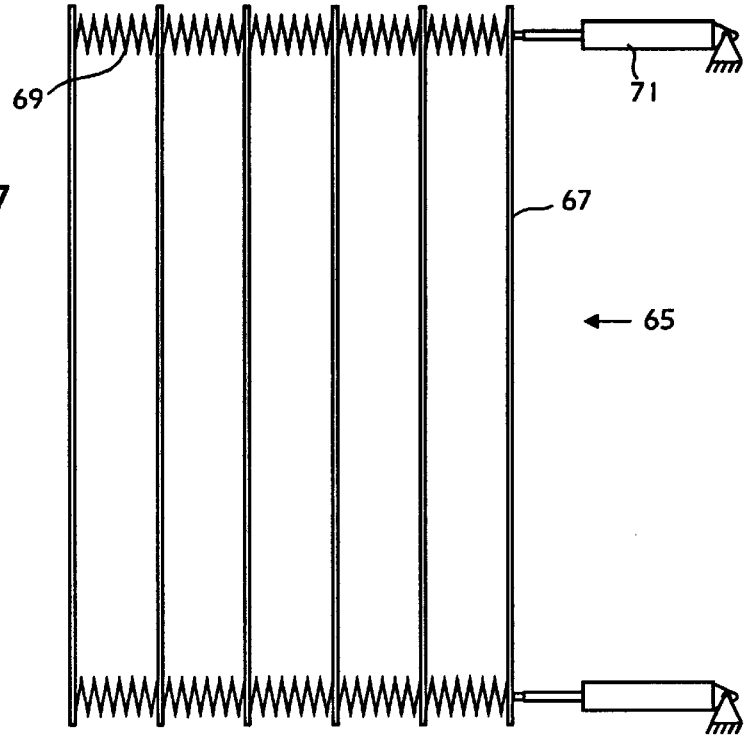
FIG. 17 shows a plate lens antenna adaptable to different frequencies.

The arrangement with a variation of the distance between the rings according to FIG. 6*b* can also be applied for existing, conventional metal lenses. A metal lens having parallel plates can be made adjustable to different frequencies by maintaining the plates elastically attached to each other and regulated by means of changes of the distances between the outermost plates, which will give equally large distances changes between all plates, as is illustrated in FIG. 17. A plate lens antenna 65 is here shown having parallel plates 67 separated by elastic means such as compression springs 69 arranged between the ends of the plates 67. One of the outermost plates, the left one as viewed in FIG. 17, is attached fixed in space, for instance attached to a frame not shown, and the other outermost plate can be displaced in parallelism, perpendicular to its extension by the influence of some suitable position adjusting means as fluid cylinder assemblies 71 having one end attached to the plate and another end to the frame.

Figure 18:
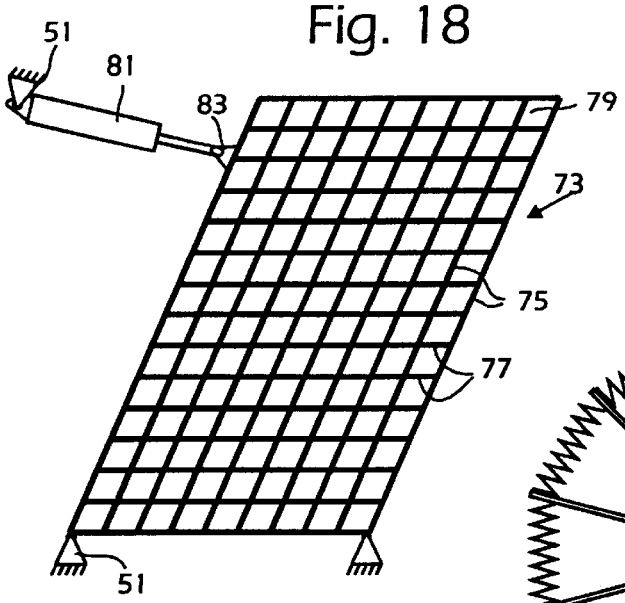
FIG. 18 shows a plate lens antenna having quadratic channels adjustable to a rhombic shape.

In FIG. 18 a possible embodiment is illustrated for frequency variation of a lens 73 having two plate groups comprising plates 75 and 77 respectively, which plates are parallel to each other within each group, and where the plates in one group are perpendicular to the plates in the other group. The plates 75, 77 are in the normal position of the lens in each group arranged in perpendicular polarization directions. The lens 73 is varied for use within a frequency range by the fact that the plates in one group, for instance 75, can be positioned obliquely in relation to the plates, for instance 77, in the other group, so that the shape of the channels 79 limited by neighbouring surfaces of the plates 75, 77 will vary from a square shape to a rhombic shape. The side walls of the channels 79 will then however deviate a little from the strictly perpendicular polarization planes and will give a rhombic focus but will at the same time provide more narrow channels and thereby an adjustment to higher frequency intervals the more rhombic or the more narrow the shape of the channel 79 will be.

The variation of the shape of the lens 73 can be provided by making the plates in one group connected through hinges to the plates in the other group at the intersection lines of the plates. An outer plate in a group must be mounted fixed in space, for instance attached to a frame indicated at 51. An outer plate in the other group is by means of a hinge 83 attached to one end of a fluid operated cylinder 81, the other end of which is mounted fixed in space (51). By the influence of the cylinder 81 the plates in the second group are then placed in an oblique position.

A lens of the type shown in FIG. 5*a* having spiral arms 37 and in addition provided with flexible radial plates 49, which are shown in dotted lines in FIG. 5*a,* see FIG. 5*b,* can be changed in its shape for a frequency adjustment in the same way. The radial space of the spiral arms is reduce by the use of a suitable mechanism, the radial plates being bent or folded a little to the side to deviate a little from the radial position.

Figure 19:
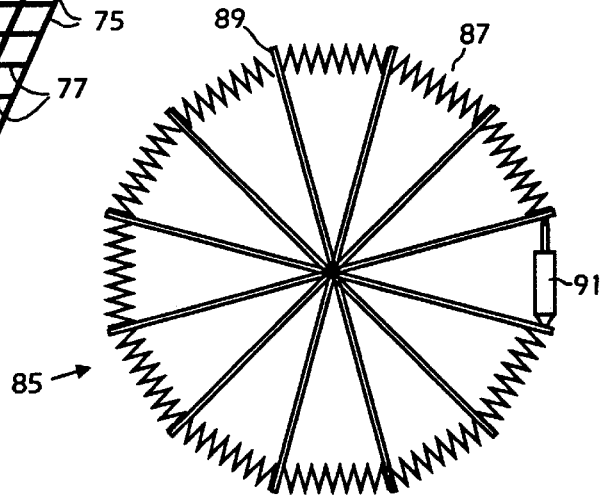
FIG. 19 shows a plate lens antenna having adjustable radial plates.

A lens 85 constructed of elastic means such as compression springs 87 and radial plates 89 is shown in FIG. 19 and provides the same possibility to a frequency adaption as the rhombic lens 73 of FIG. 18. The plates 89 are maintained separated in the peripheral direction with a constant angular separation by compression springs 87 mounted between the plates, for instance at the outer ends thereof. A change of the angular space between the plates 89 is accomplished by changing the interspace between two plates in a forced manner, whereby the angular position for the other plates 89 arranged about the lens axis is changed, so that a new angular distance is obtained between neighbouring radial plates, which distance is uniform or constant over the turn. The forced change can be produced by means of a cylinder and piston assembly 91 having its ends attached to the two radial plates which are displaced by force, for instance at points in the neighbourhood of the radially outer ends thereof.

Another possibility of making the lens antenna adaptable to different frequencies is to vary the profile heights of the plates. In FIG. 20 a device is shown therefore as applied for a lens having rings according to FIG. 1*a*. Generally this arrangement comprises, that each plate, in this case each rotationally symmetric ring, is divided in at least two plates and rings respectively with a separation surface or a border surface between the two parts located perpendicular to the propagation direction of the wave. As is illustrated in FIG. 20, each cylindric circular ring 5 can be divided in two cylinders 5', 5" made of thin materials and having nearly the same diameter. The cylinders 5', 5" are inserted in each other with some overlap and they can be displaced in relation to each other which then generally will be in approximately the propagation direction of an electromagnetic wave, for which the lens is adapted. When the lens is to be frequency adjusted for for instance a higher frequency, the rings 5', 5" are displaced in relation to each other, so that the added ring height or profile height of a composite ring 5 is increased as viewed in the propagation direction of the wave.

Preferably, the ring portions 5', 5" are displaced more in relation to each other with an increasing distance from the symmetry axis or the lens axis 3, in order to follow the lens profile for this higher frequency. For the displacement all first ring parts 5', i.e. all of those parts which are located at a first side, can be attached fixed in space, such as attached to a support not shown, and all the other ring parts 5", which all are located at the opposite side can be attached to an arm 93. The arm 93 can be operated in some suitable way, for instance by the influence of a fluid cylinder 95, which through some rod 97 is connected to the arm 93. If the arm 93 is not rigid but elastic and is attached fixed in space at the lens axis 3, such as attached to a frame 51, the arm 93 can be bent to a suitable profile by the influence of the cylinder 95 through the two rods 97, which then with one end thereof are attached to points of the arm 93 located at distances from the fixed point thereof at the lens axis. If the connection between the arm 93 and the frame indicated at 51 is hinged, the rods 97 will act on the arm 93 at points which are located symmetrically in relation to this connection part. By making the arm 93 with a suitably varying elasticity, for instance with a suitably varying thickness, a correct envelope is obtained when changing the positions of the first rings 5",so that the wave front of the higher frequency is focused.

The rods 97 can be loose flexible wires or strings. This presupposes a suitable design of the arm 93 and the elastic characteristics thereof when bent, so that it, as is shown in FIG. 20, is substantially straight at a lower frequency and for reception of a higher frequency it is to be bent to the left, as viewed in the Figure.

In another embodiment indicated in FIG. 21*a,* each parallel plate 99 in the prior plate lens construction comprising more or less plane and parallel plates, is prolonged at its straight profile side by a number of additional plates 101. These additional plates are located with portions close to and overlapping the principal plates 99 and can move in parallel thereto. The additional plates 101 are further attached in such a way that they can move between two positions, substantially parallel to the propagation direction of an electromagnetic wave which is to be received by means of the lens. The adaption can be made between the two design frequencies by the fact that the additional plates 101 are elastically attached to each other. A fluid cylinder 105 has its one end attached to each one of the outermost additional plates 101 and has its other end attached to a support fixed in space, indicated at 51. In the activation of the cylinders 105 they will displace the additional plates 101 between the first and the second position, where the first position, as is illustrated in FIG. 21*a,* can be that all of the additional plates are positioned with one edge thereof aligned with each other and the second position is determined by the fact that the additional plates 101 with one edge thereof will be engaged with supports 103 fixed in space. The centrally located additional plate can be attached to the frame 51.

In a similar way plates 29, 29', see for instance FIGS. 2*a*–4*a,* extending radially in a lens having substantially circular rings 5, can change profile to be adjusted to the lens equation for different design frequencies. In FIG. 21*b* thus radial principal plates 107 are prolonged by additional plates 109 in the same way as in FIG. 21*a.* The additional plates 109 are in addition divided in radial directions and all plates 109 located at a certain distance from the lens axis are attached to circular supports 111. The circular supports 111 are further attached to a radial arm 113, which as above, at the radially outer ends thereof, is connected to one end of fluid cylinders 115, the other ends of which are attached to a frame fixed in space and indicated at 51. The arm 113 is attached fixed in space at the lens axis and is like above made with a suitable elasticity to be bent in an extent, which varies radially.

These lenses being adjustable to different design frequencies are suitably connected to an equipment selecting the frequency range which is to be received or transmitted to/from the focus of the lenses, so that for the selected frequency range the focusing of the lens is controlled for the corresponding frequency in the indicated way by means of some control device (not shown).

Figure 7:
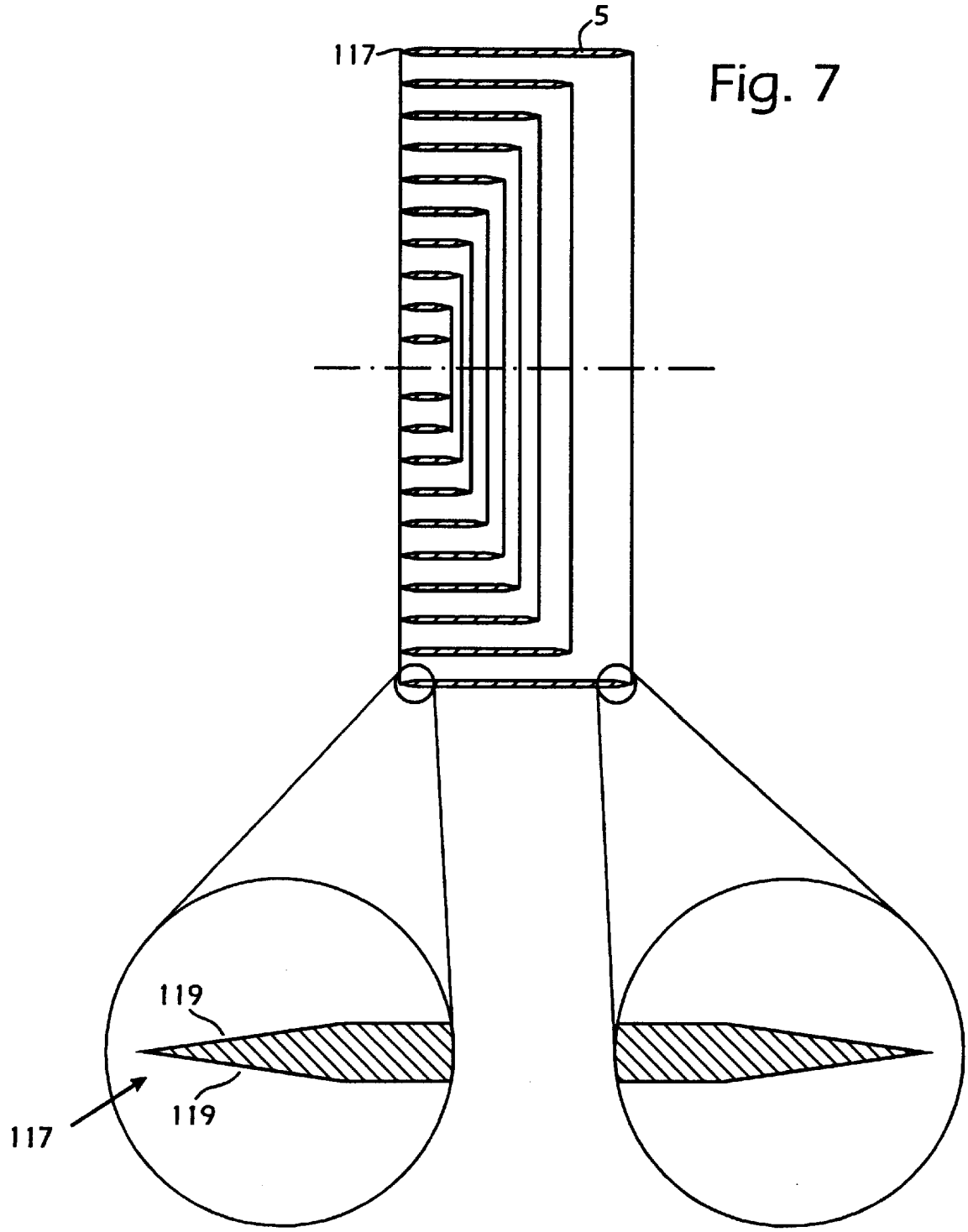
FIG. 7 shows an axial section of a lens antenna having bevelled edges.

In an advantageous embodiment, which is principally illustrated in FIG. 7, the plates and/or rings 5 of the lens are bevelled or tapering at their ends, at least on the irradiated side, i.e. the plates and/or the rings are approximately parallel and tapering or successive more narrow in the opposite direction to the propagation direction of the wave front. As is illustrated in FIG. 7, each edge portion 117 of the rings 5 (this is true also for more or less flat plates in a lens) can be shaped as a more or less sharp edge, for instance with a symmetric cross section having two equally long bevels or plane surfaces/conical (sloping or oblique) surfaces 119. The edge portion can be significantly longer than the thickness of the rings 5 (or of a plate). It is particularly simple to accomplish for a lens constructed of bands.

The waveguide channel between the plates and/or the rings 5 will hereby be tapering in the propagation direction of an electromagnetic wave, what gives three direct advantages:

1. The reflecting small end surface or gable surface 121, see for instance FIG. 1*a,* of each plate and/or ring (5) is eliminated on the irradiated side and the plates/rings can be given a thickness providing stability.
2. An impedance match can easily be made between the irradiated surface of the lens and free space combined with a distance between the plates/rings at points further inside the lens, which distance is more efficient from a refractive viewpoint. With this more efficient distance at points further inside is meant, that the surface of the plates/rings are located more close to each other at locations further inside the lens than at the entrance opening, what produces channels having a higher impedance than free space. At the same time a narrow channel gives an increased phase velocity which gives shorter channels for focusing. Such an impedance match minimizes the reflection even more, also for obliquely incident irradiation and in the case where the irradiated surface of the lens, the upper surface of the lens in FIG. 8, is curved or uneven and thus to some extent deviates from most embodiments mentioned above having a substantially flat surface on the irradiated side. In the section of a lens in FIG. 8 thus each one of the rings 5 has a larger thickness than those in the earlier embodiments, for instance 2–5 mm. On the irradiated side the rings 5 are shaped with symmetric bevels 117 as in FIG. 7 and on this side the outermost edges of the rings are not located in the same axial plane but the exterior profile of the lens can here be step shaped.
3. The oblique sides between two neighbouring plates/rings function as a horn in the direction for the incident electromagnetic wave. To the electromagnetic wave, the irradiated side of the lens is physically a surface having channel openings. There is research on the issue of the extent with which an electromagnetic wave enters such an opening and it concerns primarily how efficiently the wave will enter from different directions. The studies show a relatively homogeneous reception capability for directions straight ahead of and obliquely to the front of the channel opening. Of course, the total function of the lens is from this aspect that performance from all those channel openings which exist in the lens are added to obtain the total characteristics of the lens. It is also known that horns shield obliquely incident electromagnetic waves better and at the same time an electromagnetic wave, which arrives straight ahead against the direction of the opening of the horn, is amplified, compared to an opening of a channel having straight surfaces, i.e. having side surfaces in parallel to the direction from the front. If now the irradiated surface of the lens is constructed of such horn elements, naturally the added effect of these horn elements will be a higher amplification for waves coming straight from the front side compared to straight channels. In the reception of signals arriving obliquely from the front, in the same way the effect of the different openings is added causing that the lens having horn shaped openings shields, i.e. receives less efficiently, these signals compared to a lens having straight channels.

Figure 8:
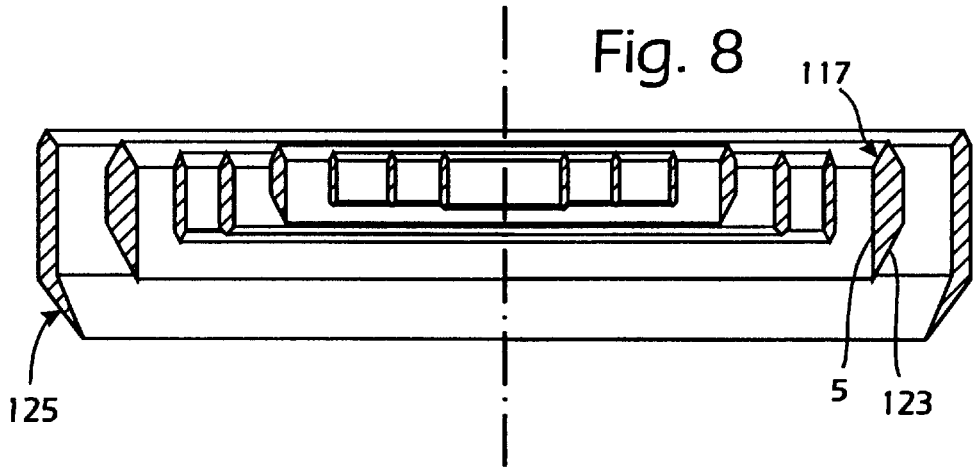
FIG. 8 shows an axial section of a rotationally symmetric lens antenna having bevelled ledges and an impedance match both on the entry and the shadow side.
Figure 9:
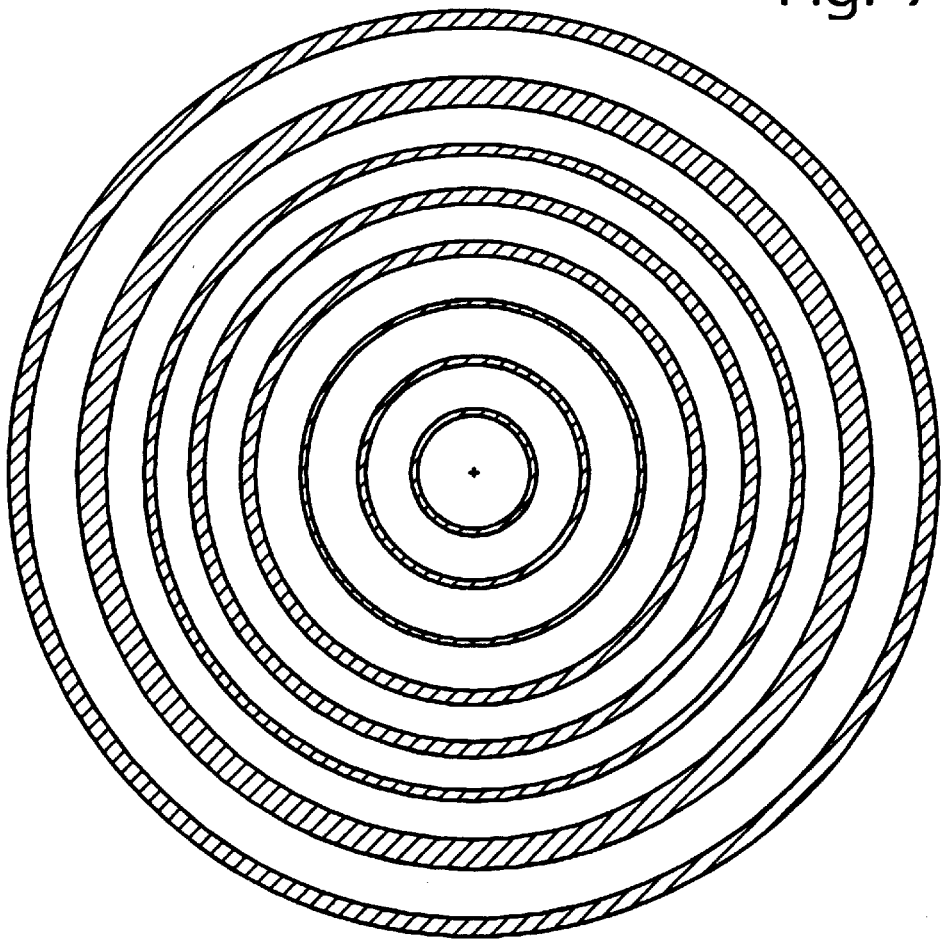
FIG. 9 shows the same lens as FIG. 8 as seen in an axial view from the front.

In the section of a lens in FIG. 8 there are also bevels on the transmission side of the lens (the lower side) and these are advantageously only made by simple bevels on the outside of the rings 5, i.e. so that some rings (for instance the inner higher rings when forming the steps of the exterior profile of the lens) are terminated by an annular frusto-conical surface 123 for forming a more or less sharp edge. It can be developed more so that the outermost marginal portion of a ring at the exit side is bent inwardly, as is illustrated for the outermost ring at 125 in FIG. 8. The outermost ring is thus terminated in the exit direction in two frusto-conical surfaces for forming a sharp edge, where the cone angles have the same sign (are situated within the same quadrant).

In this case it is a little more complicated to calculate the profile heights of the plates/rings in the propagation direction, since the distance between the surfaces of neighbouring plates/rings is not constant in the propagation direction. However, this has been made in the embodiment according to FIGS. 10, 11*a* and 11*b,* where the heights have been determined by repeated calculations of the obtained refractive index up to the exit opening of the waveguide element and a match of all the exit openings of the waveguide elements in the radial directions, so that the wave front will arrive in phase to the focus (11, FIG. 1*a* ).

Figure 11B:
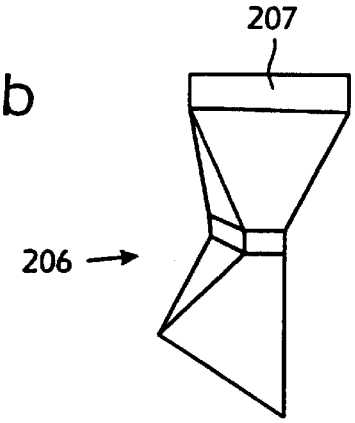
FIG. 11*b* shows a perspective view of a radial element for the lens of FIG. 11*a,*

Also the radial bands or plates for lenses constructed of more or less circular rings can be made with bevelled edges or for forming horn profiles circularly or circumferentially, see the radial element 206 in FIG. 11*b,* to thereby make the lens constructed of a number of circular or cylinder annular parts which form for instance horn shaped channels having an approximately square cross section.

Figure 10:
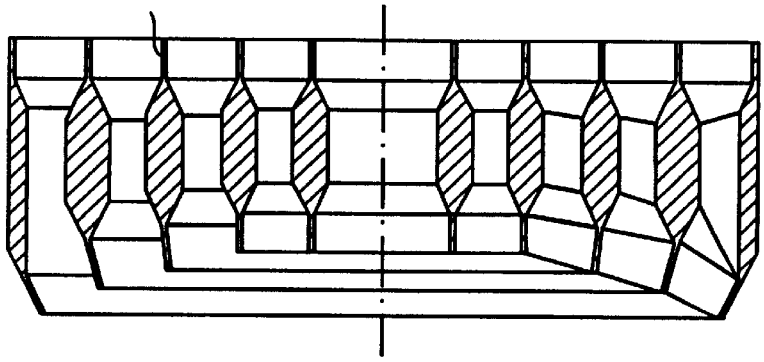
FIG. 10 shows an axial section of a rotationally symmetric lens antenna having bevelled edges and channels of horn type, radial and circular plates.

In the lens illustrated sectionally in FIGS. 10 and 11*a* the bevelled edges on the irradiated side are prolonged by thin conductive bands or plates 207 extending perpendicularly to the irradiated surface of the lens, i.e. approximately parallel to the axis. Thin conducting edge terminations are also provided in the lens according to FIG. 10 on the exit side but here they must not necessarily be parallel to the axis. The radial element 206 illustrated in FIG. 11*b* is intended to be placed in the outermost annular channel in the lens of FIG. 11*a* and has the general shape of a double cone with a small central area having a more uniform thickness.

The thickness of the plates/rings will in this case be significant and they should suitably consist of an exterior conducting layer, which is electromagnetically suitable for the design frequency, for instance of aluminium, copper, gold or silver, and an interior core of stabilizing filling materials such as a plastics material.

Figure 13:
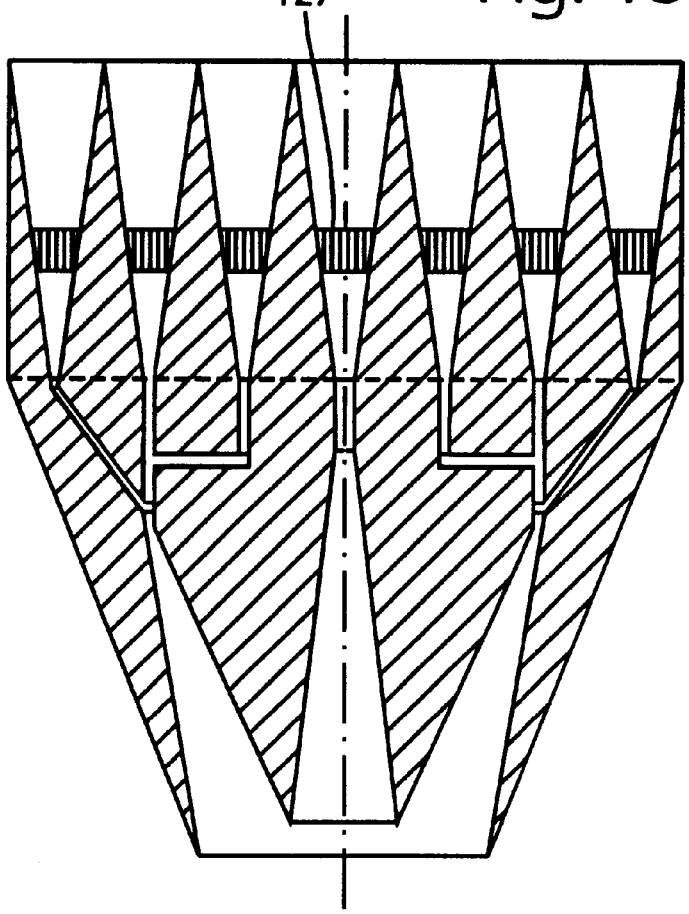
FIG. 13 shows a section of a lens having an entrance opening of dielectric horn type and an exit opening of horn type.
Figure 14:
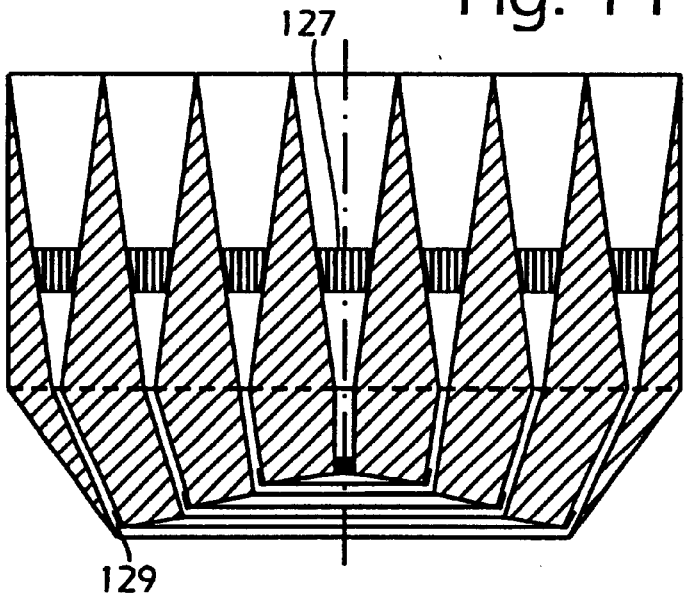
FIG. 14 shows a section of a lens having an entrance opening of dielectric horn type and an exit opening with dielectric edge portions.

In an embodiment, see the schematic sections of lenses in FIGS. 13 and 14, the rings/plates of the lens comprise coatings, such as annular areas 127 in FIGS. 13 and 14, located approximately at the middle of the bevels and on the entrance side, of dielectric materials for impedance matching or in order to increase the directivity of the lens, reduce the side lobes for especially small antennas and increase the frequency range. The structure thereof can be designed according to the descriptions found in the book "Dielectric and Dielectric-Loaded Antennas", Rajeswari Chatterjee, 1985, section "Dielectric loaded metal horns".

FIG. 13 shows a lens shown sectionally and constructed of rings. At a known distance inwards along into the horn wall dielectric material is attached in circular bands which thereby reduces side lobes for the horn profile. The microwave is then led through circularly symmetric channels to exit openings which all face the focus. The innermost opening is a horn while the outer rings form circular grooves, the rotationally symmetric channels from the interior of the lens located at the bottom. Sectionally it looks like a horn. When these circular recesses are divided by radial plates of the type according to FIG. 11*b,* all circular channels and recesses are transferred to channels having an approximately quadratic or generally rectangular cross section.

Also the exit openings can be coated by dielectric materials according to known methods to impedance match the channel openings to free space. In FIG. 14 exit openings are shown of a lens which is coated by dielectric bands 129 on one wall in the circularly symmetric openings and close to the terminating edge of the exit openings. This balances the refractive index of the electromagnetic component of the wave parallel to the recess and to some extent also of the radial component. Also here the construction can be supplemented by radial plates, for instance of the type according to FIG. 11*b.*

An impedance match can thus be made by coating the circular rings and the radial plates with a dielectric material within suitable areas in the entrance and exit openings of the channels. The knowledge that channels having their inner side coated by a dielectric material influence the refractive index, is known from an article by DeVore, H. B., RCA Review, Vol. 9, 1948, page 721.

A dielectric material having a refractive index >1 causes that the refractive index of the channel which is <1, will be greater. With a coating of for instance about 2 mm around the inner side and at the outermost marginal portion of an entrance opening of about 19 mm the refractive index of the channel will be approximately equal to 1, when the coating is formed by dielectric material having a refractive index equal to 2.2. If the thickness of the dielectric material then gradually is reduced inwards the channel, the refractive index will here be equal to that existing in such an uncoated channel, i.e. in the example about 0.67. Such an arrangement reduces the reflection in the entrance opening to practically zero.

By coating the entrance opening in this way by a dielectric material, such that the refractive index in the entrance opening will be approximately in the middle of for instance that of free space and the refractive index further inside the channel, the following can be achieved: If the coating is continued a distance inwards the waveguide channel, which is equal to ¼, ¾ or generally (¼ of a wavelength+(i·0.5 wavelengths)), i=1, 2, 3 . . . , where the wavelength is that existing in the channel with a coating, an anti-reflection treatment of the lens is obtained. The reflections appearing in the transitions at the entrance opening and the place where the dielectric material terminates, will eliminate each other according to known methods for anti-reflection treatment. This can in a similar way be made in the exit opening of the lens (as is illustrated in FIG. 14) in order to reduce reflections and losses.

Figure 12A:
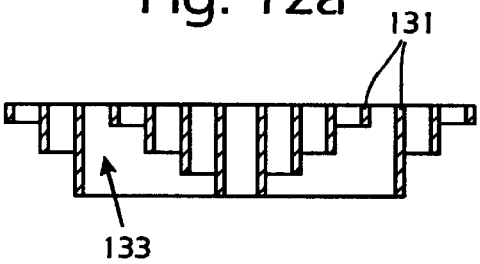
FIGS. 12*a* and 12*b* show sections of rotationally symmetric lenses constructed of dielectric elements.

In an embodiment which is schematically shown in a section according to FIG. 12*a,* the elements of the lens consist of a dielectric material, which gives the same simple construction with circular, cylindrical tubes or rings 131 or near circular spiral bands. If all rings/spiral bands are made with the same thickness, the lens profile, i.e. the envelope of the end surfaces of the ring elements, here follow the lens profile for a lens having a refractive index >1, i.e. the profile heights of the circular rings or the spirals follow the equation for lenses of the type solid glass or plastics, with the difference that the refractive index of this lens will be equal to or lower than that for a solid lens of the same material. It is here also possible to stepwise increase the edge height of the tubes 131 in the case where the lens thickness (tube height) will be near zero and thereby focus an earlier phase from the radiation source to the same focus. Thus in FIG. 12*a* a lens profile is shown provided with steps 133 at the exit side where the profile on the entrance side (at the top of FIG. 12*a*) can be flat. A receiver unit is illustrated at 134 in the shape of a microwave horn. When the lens is used for transmission, the unit 134 is instead a suitable transmission or radiation source.

Figure 12B:
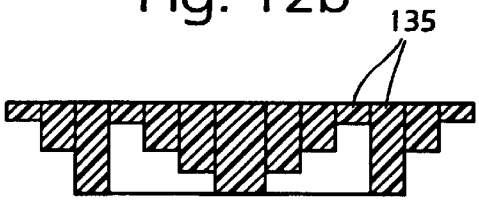

The same refractive index as for a solid lens is obtained if the tubes, rings or spirals are located tightly to each other turn by turn to build the lens profile. In FIG. 12*b* a section is shown of such a solid lens constructed of elements comprising dielectric cylindrical rings 135 located close to each other, which all have the same radial thickness except the innermost element 137 which is a solid cylinder.

The refractive index of a dielectric tube has been calculated by for instance Mallach (1948), Kiely (1950), Gallet (1969) and Narasimhan (1969). The interspace of the plates in the embodiment according to FIG. 12*a* is selected according to the research by Yip (1974), where the selection of the wall thickness of a tube in relation to the dielectric constant of the material in question and the exterior radius gives an optimal efficiency to the tube. The result of this study has in this example (FIG. 12*a*) been followed by composing the lens of dielectric tubes located at a radial distance of the same size as the diameter of the tube, which Yip has found to give the best radiation efficiency. Thereby a lens is achieved having a better impedance match and a lower reflection than a solid lens of the same material.

Figure 26A:
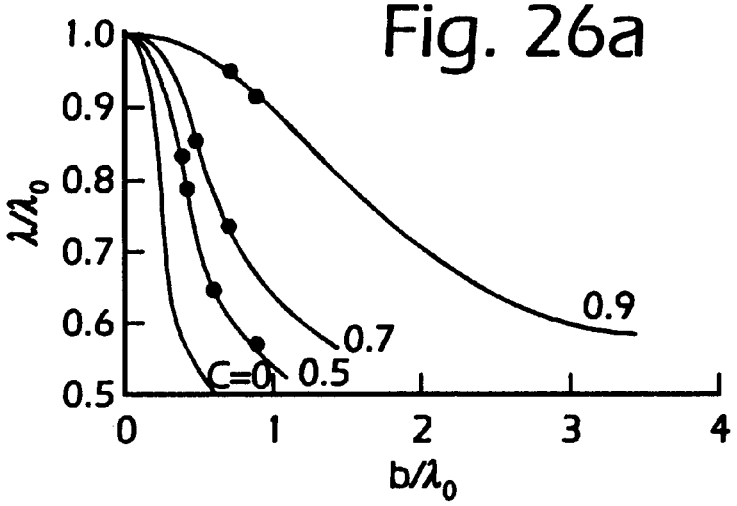
FIG. 26*a* illustrates the refractive index of a dielectric tube.
Figure 26B:
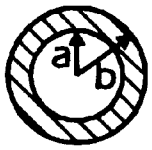
FIG. 26*b* shows the section of a dielectric tube.

In FIG. 26*a* a diagram according to Yip is shown for a dielectric tube 137 having an inner radius a and an outer radius b, see the cross section in FIG. 26*b*. The diagram has as abscissa the ratio $b/\lambda$ and as ordinate the relation $\lambda/\lambda_0$, where $\lambda_0$ is the wavelength of the electromagnetic wave in free space and $\lambda$ is the wavelength inside the tube 137, for various values of the ratio c of the inner and outer radii, $c=a/b$. The diagram illustrates generally the relation between the exterior radius b, the wall thickness and the dielectric constant of the tube, where the latter also can be regarded as a refractive index, and gives the length of the tubes according to the equation for optical lenses. The approximation according to lens formula will be better the smaller the distance is between neighbouring dielectric rings and this distance should be smaller than the wavelength in order that the approximation should be possible to use at all.

It is also possible to introduce, in the open dielectric lens constructed of concentric rings 131 according to FIG. 12*a,* radial bands of dielectric material, having edge heights in accordance with the lens formula for the dielectric material and considering the increasing distance circumferentially between the radial plates, when passing outwards from the lens axis. The radial plates can thereby be made as short simple plates having a straight edge between two neighbouring ring elements 131 or as longer radial plates extending over several circular rings 131 and being made with steps, as has been described earlier with reference to FIGS. 2*a*–4*a*. The general configuration thereof agrees with the corresponding metal elements 29, 29' but their edge profile is different.

The dielectric rings/plates can, in the same way as for the other antennas mentioned constructed of conductive elements, be made with their large surfaces approximately parallel to the propagation direction of the wave and/or in addition be bevelled at the entrance/exit openings of the lens, compare for instance FIG. 8. Thereby a better directivity is achieved according to studies of dielectric rod and horn antennas, see the book "Dielectric and Dielectric-Loaded Antennas", Rajeswari Chatterjee, 1985.

The lens described with reference to FIG. 12*a* comprising more or less rotationally symmetric dielectric elements or a totally conventional lens of optical type comprising a single profiled dielectric lens plate can be combined with the circular bands of the metal lens by means of lens portions which are cut out rotationally symmetrically about the lens axis. This gives advantages obtained from the two structures and eliminates disadvantages thereof respectively. For instance the weight can be reduced in relation to a lens comprising only dielectric elements and at the same time the thickness of a metal lens is reduced.

Figure 22A:
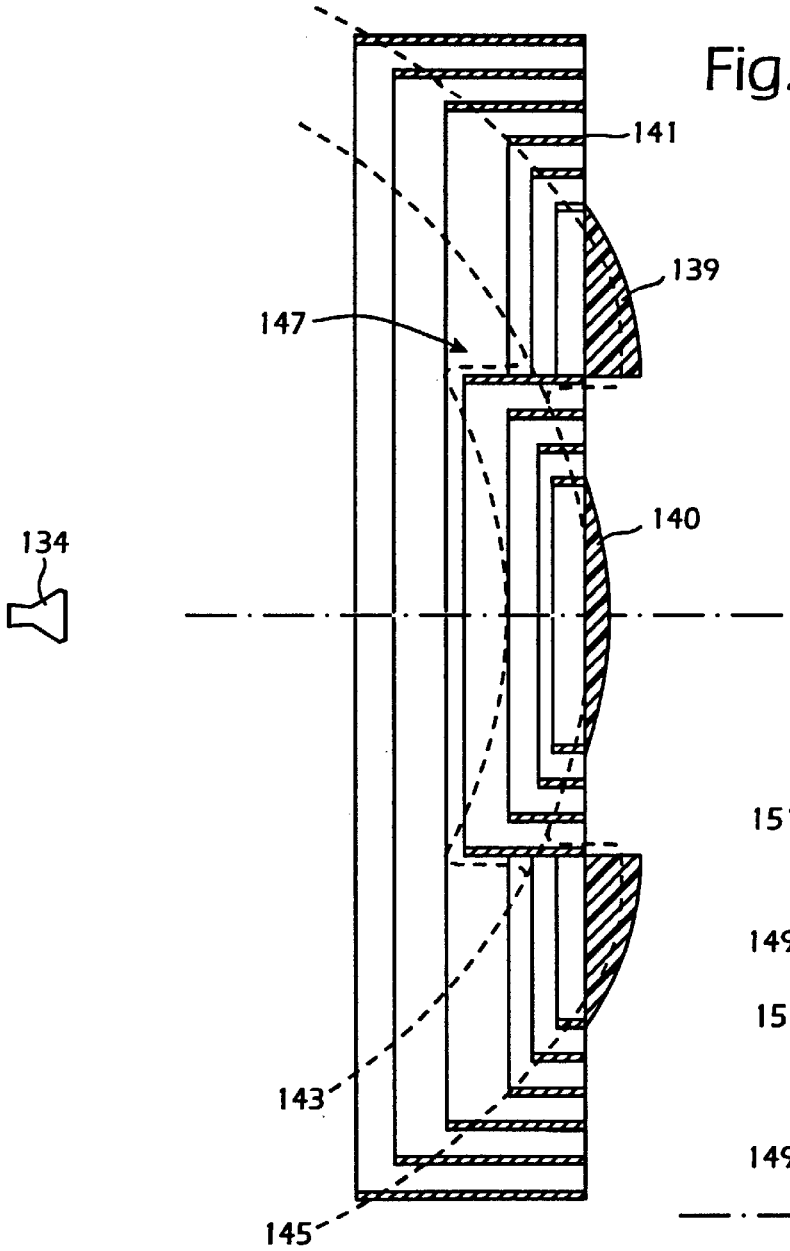
FIG. 22*a* shows a section of a lens, where circular dielectric lens parts are combined with a metal lens.

In FIG. 22*a* a section of a composite lens is shown, where circular dielectric lens portions are combined with a lens constructed of metal components in such a way, that the frequency dependent characteristics of metal lenses are widened within a wider frequency range. It is a fact, that the further away the wavelength of an electromagnetic wave is from the design wavelength for a lens comprising only metal parts, the larger the phase error will be, when the wave passes through the metal lens. The phase error depends on the fact that the phase velocity of the wave increases in a channel in the lens, when the frequency is reduced from the frequency corresponding to the design wavelength for the lens, and that the phase velocity is reduced for frequencies higher than the frequency corresponding to the design wavelength. The longer a channel is, the larger the phase error will be.

This condition has earlier been carefully studied and solved by making the center of plate metal lens consist of channels extending over several wavelengths. A special method was developed and requires in order that the stepwise decrement shall be designed with the least possible phase error, that for the lens a thickness or a depth in the propagation direction is required, which comprises at least two wavelengths at the center or axis of the lens. This will primarily result in that good metal lenses will lack transparency and airiness. The construction according to FIG. 22*a* gives a thinner metal lens with an airy configuration. It is material saving and at the same time the phase error can be eliminated by means of the dielectric lens approximately in the same way as with long central channels.

In FIG. 22*a* the longest channels in the metal lens have been substituted by rotationally symmetrical, cut out lens portions 139, 140 of a dielectric material, an outer ring 139 and an inner, centrally located lens portion 140. The step between two wave fronts can thereby be made more smooth compared to known step methods for metal lenses, so that the longest channels are replaced by a rotationally symmetrical cut out part of for instance a solid dielectric lens. The metal rings 141 between the dielectric lens parts 139, 140 constitute a substitution of dielectric lens material by lighter and more airy metal elements. The concentric cylindric metal rings 141 have here, as for instance in the embodiment according to FIG. 1*a,* all the same thickness but differing edge heights and are located with one of their sides along an axial plane. The dielectric lens parts 139, 140 extend from this axial plane but to the opposite direction compared to the metal ring parts 141.

The phase front for a wave from the irradiated side is divided by stepping methods in two phase fronts 143, 145, which both arrive together in the focus (11, FIG. 1*a,* at the receiver 134 in FIG. 22*a*). The phase front 143 is given a lower phase velocity in the travel through the central lens part 140 and is given an increasing phase velocity through the metal rings 141 located directly outside the central dielectric lens 140. Thereby a common phase front occurs in focus. The phase front 145 appears in the outer annular dielectric lens part 139, which reduces the phase velocity to the extent, that the phase at the exit from this lens part 139, is in harmony with or is in phase with the phase front 143 exactly one wavelength later than the phase front 143, to the focus. The circular metal rings 141 directly outside the outer dielectric lens part 139 increase this phase front for a continued adaption to the phase front 145, etc.

The selection of position of a phase step (such as at 147 in FIG. 22*a*) can be selected depending on the case, for instance if one wants to have the least possible phase error, the least amount of lens material or the lest possible dimension according to known methods.

The solid dielectric lens parts 139, 140 of FIG. 22*a* can obviously be replaced by circular or near circular parts such as tubes having spiral shapes and made of dielectric materials (compare the tubes 131, 135 of FIGS. 12*a* and 12*b* respectively).

Figure 22B:
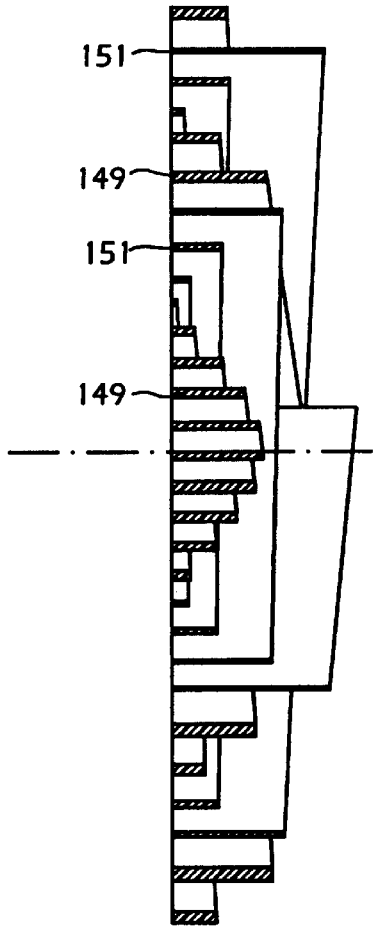
FIG. 22*b* shows a section of a lens having a band in the shape of a spiral consisting partly of dielectric material, partly of metallic conducting material.

In FIG. 22*b* thus a section is shown of an embodiment of a lens comprising a spiral, constructed of both a dielectric material 149—i.e. having a refractive index >1, and of material 151 having conventional metal lens properties—i.e. having a refractive index <1, in order to achieve essentially the same characteristics as in the preceding example with annular metal parts and solid lens parts (according to FIG. 22*a*). The central lens part 140 in 1 the lens of FIG. 22*a* here corresponds to the fact that the central inner part of the spiral band is made of a dielectric material 149 which has a uniform thickness and a suitable profile height. After that, when passing outwards from the axis of the spiral and the lens, a section of thin material 151 follows, corresponding to the metal rings 141 located closely outside the central lens part in FIG. 22*a*. After that a section of dielectric material 149 follows, corresponding to the outer annular lens 139 of FIG. 22*a*. Then again there is a section of metal material, a section of dielectric material, etc. The spiral band can have a shape with an entirely straight edge, so that the lens at the entrance side thereof is given a profile extending in an axial plane, the other edge extending along a more or less shaped curve having steps.

The rotationally symmetric and annular construction elements or the elements having a spiral shape, made of conductive material in the fundamental embodiment according to FIG. 1*a* can also be designed for accomplishing a lens of channel-length-delay-character, compare the patent U.S. Pat. No. 2,841,793. Rotationally symmetric concentric ring elements 153 having a curved axial section according to FIG. 24 can for example be used for forming channels between the elements 153 according to a known relation between channel length and the radial position of the channel. The channel 155 closest to the lens axis is formed by partly the conductive surface $\mathbf{153}_0$ of a central element, which is shaped like a rotationally symmetric double cone, partly by the inner surface of an annular element $\mathbf{153}_1$, having a double frusto-conical shape. At a radially larger distance from the lens axis more rotationally symmetric annular elements having double frusto-conical shapes are situated. The length of the channels decreases at farther distances from the lens axis. Where the length of the channel approaches zero, the last, as seen in a radial direction outwards from the lens axis, rotationally symmetric conical ring of the lens is located. After that further channels may be added to increase the phase velocity to increase the radius of the diameter of this lens type, which otherwise is limited due to the fact that the radially innermost channels for a lens having a large radius would have to be made so long, that the construction is unwieldy.

Figure 24:
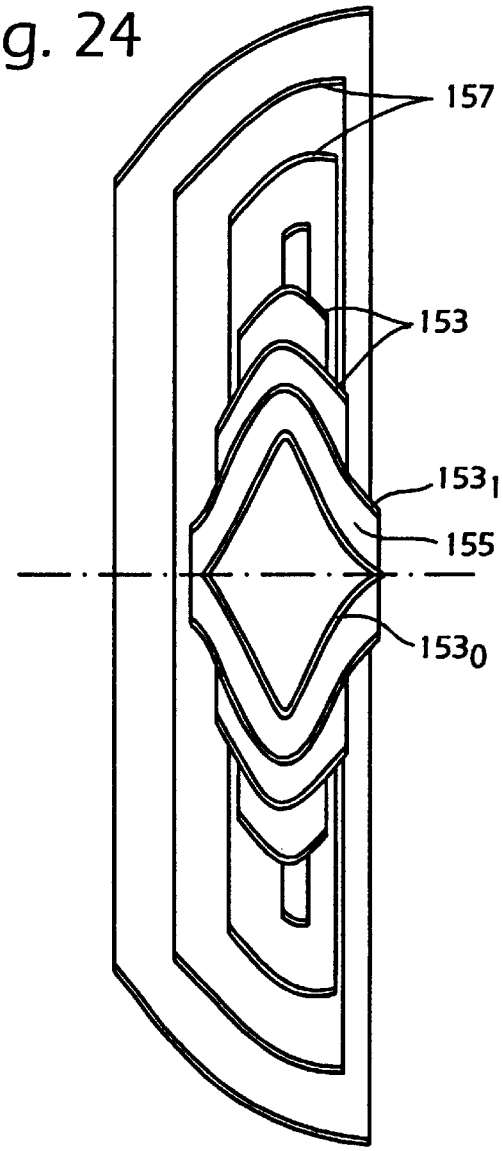
FIG. 24 shows a section of an embodiment of a rotationally symmetric lens of partly channel-length-delay-character.

In the embodiment according to FIG. 24 therefore also concentric metal rings 157 are arranged outside the centrally located rings 153, such that between the outer rings 157 channels are obtained which are formed as in the embodiments described above to have an increased phase velocity. The outer metal rings can have frusto-conical shapes with a suitably curved axial section profile. FIG. 24 thus shows a rotationally symmetric metal lens of partly channel-length-delay character, partly increased-phase-velocity character.

Figure 25B:
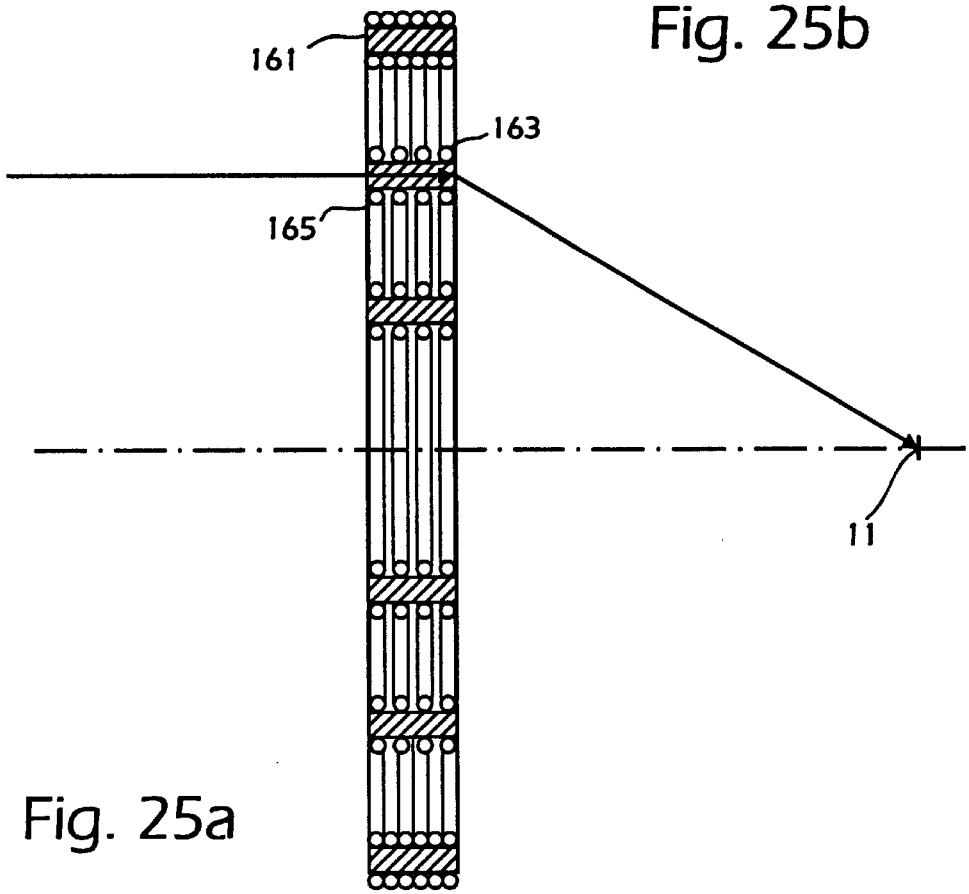
FIG. 25*b* shows a section of a rotationally symmetric metal lens having ferroelectric elements provided with inner and outer windings.
Figure 25A:
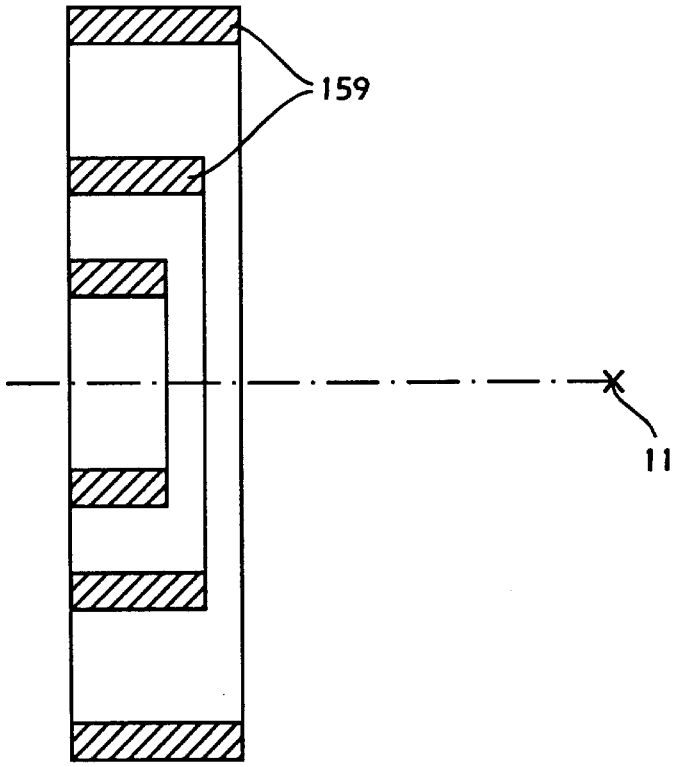
FIG. 25*a* shows a section of a rotationally symmetric metal lens having ferroelectric elements.

In another embodiment, see the cross section of a lens in FIG. 25*a,* circular or nearly circular bands 159 or bands having spirals shapes, made of a ferroelectric material, are arranged and it is particularly suited for receiving transmission of circularly polarized waves. The spacing of the ring elements 159 and their extension in the propagation direction are calculated so that the electromagnetic wave is brought in phase in the focus 11. The ferroelectric annular elements 159 produce a phase shift of the electromagnetic waves which is proportional to the length of the annular element in the propagation direction. This gives a lens profile where the thickness of the lens has been adapted considering the distance from the lens axis in order to phase shift the electromagnetic wave so much that it agrees with the phase in the focus 11. The heights of the rings are designed when passing outwards radially, according to the equation for the amount with which the ferroelectric material angularly shifts the phase of the wave per distance unit, which means an approximately linearly increasing phase shift in relation to the extensions or profile heights of the ferroelectric rings 159 in the propagation direction.

In order to give this lens an adjustable focus for different frequencies and in the first place in order that it shall be adaptable for the two circular polarization directions, see the cross section of a lens in FIG. 25*b,* each ferroelectric angular element 161 has been surrounded by an outer 163 winding and an inner 165 winding, which by control of the current intensity through the winding individually for each plate regulate the phase shift in the ferroelectric material according to known methods, so that the focus 6 is adjusted. In this case the annular elements 161 may be designed so that profile heights, adjustment of the current intensity through the windings 163, 165 and the fact that they are made with a suitable number of winding turns together give the phase shift which accomplishes a focusing. Hereby for instance lenses having a uniform thickness can be obtained.

Figure 23:
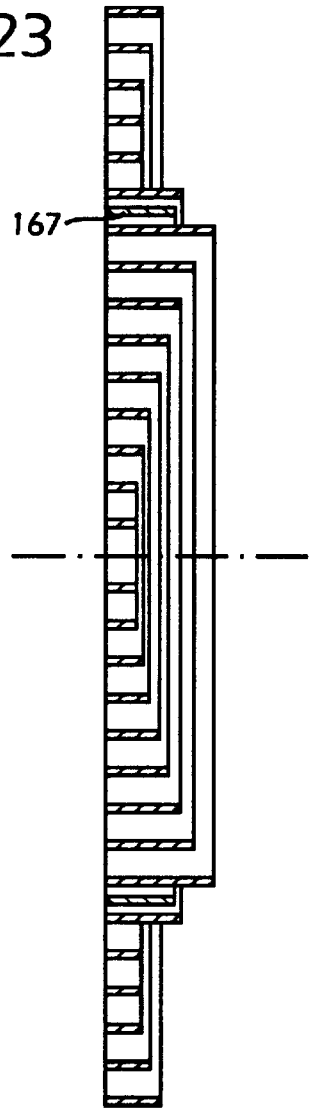
FIG. 23 shows a section of a rotational symmetric metal lens having inserted ferroelectric ring elements.

Bands or rings of a ferroelectric material can also be introduced in channels in a metal lens (for instance made as the fundamental embodiments of FIGS. 1*a,* 1*b*) to reduce the thickness of the lens and to give a wider frequency range to the focused wave. For instance, as is illustrated by the cross section of a lens in FIG. 23, a ring 167 of a ferroelectric material may be introduced between two annular elements of a conductive material or a metal in one of the embodiments described above. The extension of a conducting annular element in the radiation direction can thus for instance be reduced to approximately one half, if the rotationally symmetric ring 167 of a ferroelectric material is introduced in the channel next to and inside this annular element. The extension of the ring 167 in the radiation direction shall be such that the electromagnetic wave is phase shifted 180 degrees in the channels adjacent to the ferroelectric ring.

The particular structure comprising annular elements in the embodiments above can also be used to produce, in a simple way, a waveguide lens of phase-shift character, compare the above mentioned patent U.S. Pat. No. 4,321,604. The extensions of the rings in the propagation direction of an electromagnetic wave are designed so that the waveguide channels have a length giving all waves from the focus out to the aperture plane the same time delay plus the extra length required for the extension of the phase shifting half-wave plates according to prior art.

Radial plates can be introduced and dimensioned considering the spacing of the plates and the known equation for the lens profile of phase shifting lenses. In the produced channels the mentioned half-wave plates are inserted and oriented considering the distance from the lens axis and the length of the channel according to prior art, which thus will focus the phase in all channels to one focus.

The simplicity of annular elements extending symmetrically about the lens axis can also be applied in lenses of the type called "metal-wave-delay lens", where metallic obstacles having suitable dimensions delay an electromagnetic wave. The profile of such a lens corresponds to conventional wave delay lenses of the type glass lenses for light, and the obstacles correspond to the molecules in the glass lens, though in an enlarged shape. Obstacles in the shape of straight bands have for example been proposed to provide a lens, see the patent U.S. Pat. No. 2,627,027.

For focusing a plane wave it is, however, also here suitable to arrange these obstacles symmetrically about a lens axis. By arranging these obstacles in the shape of annular or cylinder parts circularly symmetric about the lens axis, according to the embodiments described above, but where the ring elements for example have a small extension in the direction of the lens axis and a large extension in the radial direction and by the fact that several plates are located at a distance inside a lens profile, one obtains a wave delay lens with the same simplicity as above.

In an embodiment of the lens according to the fundamental type as has been discussed above, for instance with reference to FIGS. 1*a*–4*a*, the edge heights are exactly half of the calculated ones for the lenses described above in the case where a flat mirror is mounted close to the lens, so that the wave front passes through the lens twice and is focused to a focus which then is located on the irradiated side. This lens is well adapted for geographic areas where the receiver antenna is to be arranged close to a wall and it is required that the focus is mirrored back to the irradiated side. A flat mirror is significantly simpler in the construction thereof than for instance a parabolic surface, and thus such a lens in combination with a flat mirror will be a cheaper, more efficient and simpler arrangement having a better directivity than a parabolic reflector. The lens structure can further be designed to form a part of a hybrid antenna, in particular where influence of electromagnetic waves is still accomplished symmetrically about the lens axis but where for example the wave phase front is not flat anywhere but is forwarded to further elements in a transmitting or receiving system.

In another embodiment for millimetre waves the lens is made according to the method with bands having spiral shapes, where the distance material between the plates consists of a rolled-on material, transparent to electromagnetic waves, in this case advantageously a band of foamed plastics, which has been inserted between the spiral arms. The interspace in the spiral structure according to FIG. 5*a* can thus be filled with for example foamed polyurethane.

Figure 28:
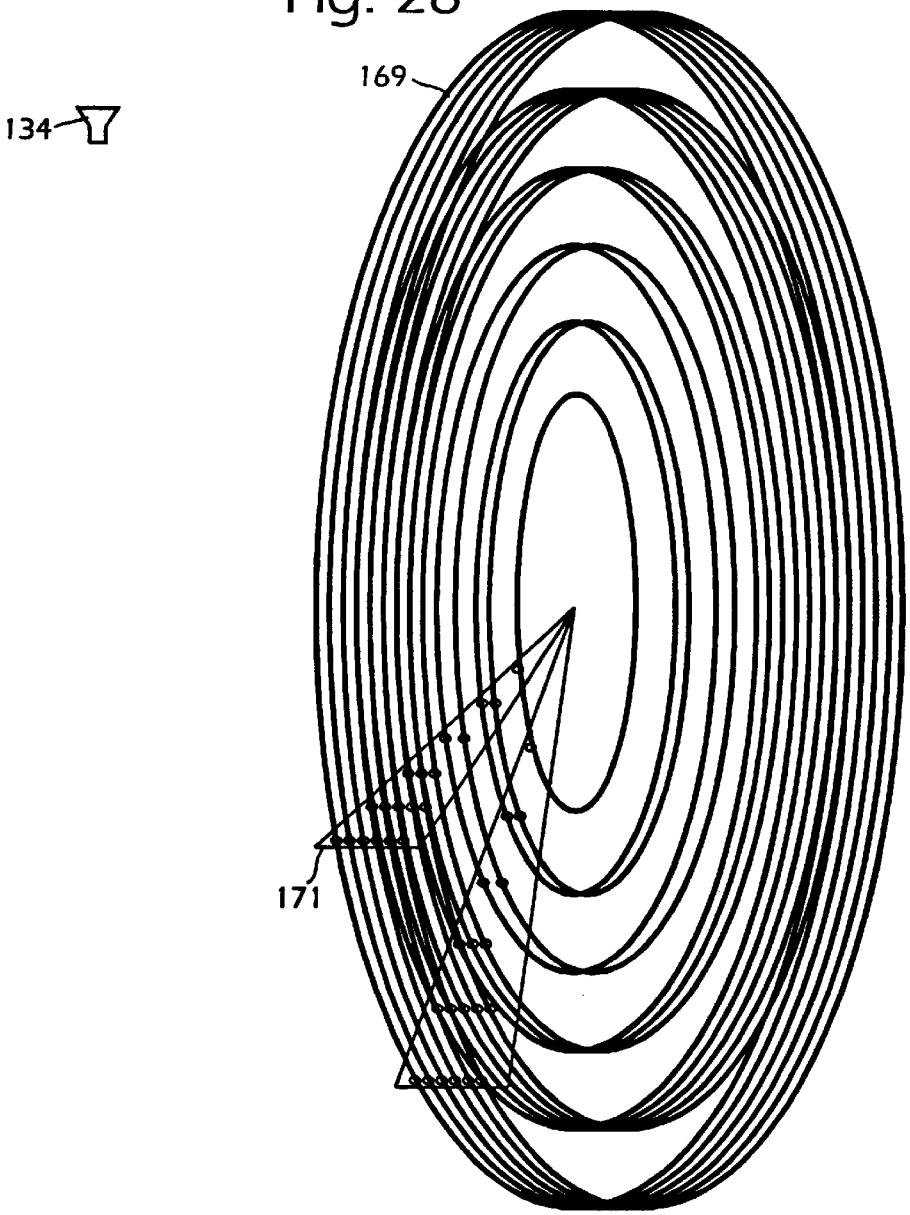
FIG. 28 shows ring elements constructed of wires having principally the same function as bands or cylinder surfaces.

In all embodiments it is according to prior art possible that the rings/plates are perforated or consist of a number of thin bands or threads. Such an embodiment is shown schematically in a perspective view in FIG. 28, where each concentric ring is replaces by equidistant parallel conductive wire rings 169 extending concentrically about the lens axis at the positions where the ring elements above have been described to be positioned, and located in the axial direction for a filling effect along the described extension of the annular elements in the direction of the lens axis. The refractive index can then be calculated with a correction factor determined by Macfarline (1946).

If these thin bands or wires 169 are sufficiently small or narrow, it is possible to make lenses having refractive indices about for instance 0.6 and having waveguide channels which are significantly smaller than half the wavelength. If for instance the wavelength in free space is 10 cm and the width of channels constructed by sides of conductive wires is 4 cm, it is known that wires of 3 mm diameter give a refractive index of 0.6. It has been considered impractical to make lenses for shorter wavelengths than 10 cm from these wires since the wire is then too thin. In an embodiment comprising the cylindric conductive rings or bands having spiral shapes described above it is however totally possible to replace them with thin wires since these wires in their whole extension simply can be supported by distance material (not shown) in the circular and radial directions and/or radial plates 171 or radial wires having the same function.

The embodiments which have been described herein for a lens having circular or radial rings/plates, can by selecting perforations or wires be varied to achieve the same technical effect, as a rule by the relation that wires or perforations change the refractive index. It may also have other effects, such as for instance that by etching a special pattern of electromagnetic conductive material on a support material in circular bands form for instance dipole effects in the conductive material or embodiments of type helical lenses, which further enhances the directivity and/or other factors combined with the effects described herein. It is not possible to describe here all these variations but they must be considered as modifications obvious to one skilled in the art, based on the fundamental ideas which have been described above.

In another embodiment the lens is cut, i.e. it is constituted by a cutout part of one of the lenses described above, which generally have been indicated to have an essentially circular outer outline, as viewed in the direction of the lens axis. It is also possible to combine two or more lenses or parts thereof with a connected receiver horn between the foci, which arise, for a source, or combining two or more lenses to obtain a common focus from several sources.

There are further methods of varying the embodiment of this invention according to the basic ideas in the simple structure. For instance the circular bands may be approximately circular as has been described above being substantially circular or rings and bands having spiral shapes, but the extension within shorter sections of the periphery of the bands can have another shape, for instance as has been indicated earlier (FIG. 4*b*) the bands may be flat between the radial supports, so that a N-sided polygon figure is formed, as seen in the direction of the lens axis. Such a structure gives a nearly as good result as rotationally symmetrical bands, in particular if the natural number N is relatively large. If the number N is small, the bands can be adapted to follow the lens profile over the Nth part of its periphery where they are flat, by the fact that each such flat part has an curved profile edge in the direction of the lens axis between two radial supports, i.e. so that a flat part is given a shorter profile height in the direction of the lens axis at positions between two supports than at positions close to the supports.

Also the radial plates can be varied, for instance by other combinations of the dimensions of the mentioned plates and their relation to each other outwards along the radius, for instance so that some plates extend in parallel outwards along parts, of the radius or so that the plates are made wider outwards along the radius whereby two bands form a channel, the width of which is constant outwards along the radius.

Another example is making the radial plates compensate the directivity of the electromagnetic wave in the H-direction in the neighbourhood of a step, exactly as have been mentioned for the circular plates. The radial plates here form a relatively longer channel, which is accomplished by the fact that the step is placed farther outwards from the lens axis in relation to what is mathematically possible, partly by the fact that the circular plate has a slope or slant, as has been earlier described.

The bands can further be constructed according to known methods, for instance of a composite material, where a core of stabilizing nature is combined with layers, which are suitable to electromagnetically influence the waves as is intended according to this description and which are to be placed on one or two sides of said core material. The core material can for example be carbon fibre/epoxy plastics, the stiffness and temperature characteristics of which are known, as a suitable rigidifying material for the construction of metal lenses.

Figure 29A:
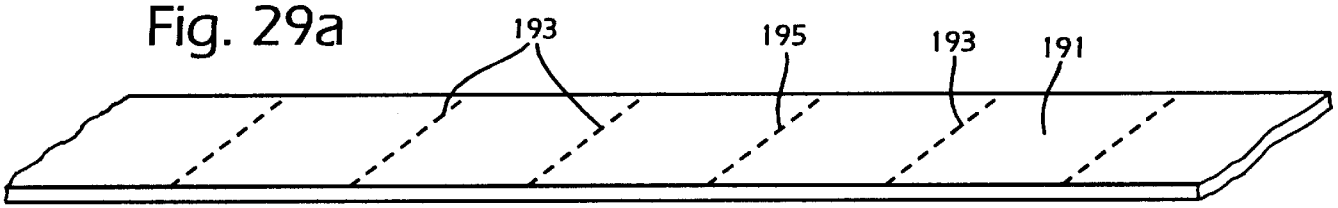
FIG. 29*a* shows in a perspective view a section of a band for folding to plates in a lens.
Figure 29B:
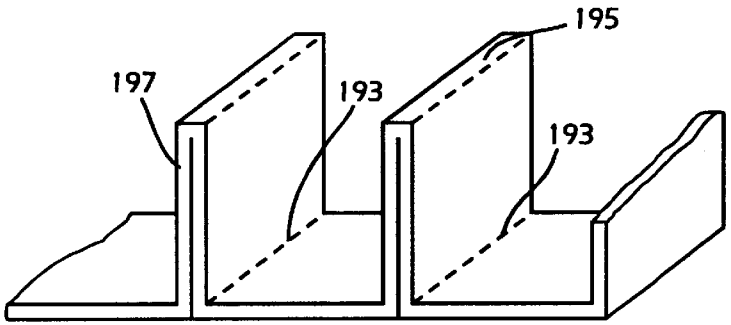
FIG. 29*b* shows in a perspective view the folded section of FIG. 29*a,*

Several practical simple possibilities for manufacturing the basic versions of the lenses described above exist. A method which provides stability and at the same time saves material and is simple in regard of the manufacturing methods is the following:

A metal band 191, see FIG. 29*a,* having a width corresponding to the extension of a circular ring 5 in the direction of the lens axis in for instance the embodiments according to FIGS. 2*a*–4*b,* is folded along lines 193, 195 according to FIG. 29*b,* so that the band 191 alternately will be one of the radial plates 29, then the section of a circular ring 5, which is located between neighbouring radial plates, after that again a radial plate 29 and so on. This is achieved by means of foldings of the band in angular grades according to the following. First a folding along a line 193 of about −90°, then at a distance from the first folding equal to the extension of the channel radially a folding along a line 195 of about 180° and after an equally long distance again along the band, a folding along a line 193 of about −90°. The procedure is repeated again from this third folding after a distance equal to the extension of the channel in the circular or approximately circular direction.

Figure 29C:
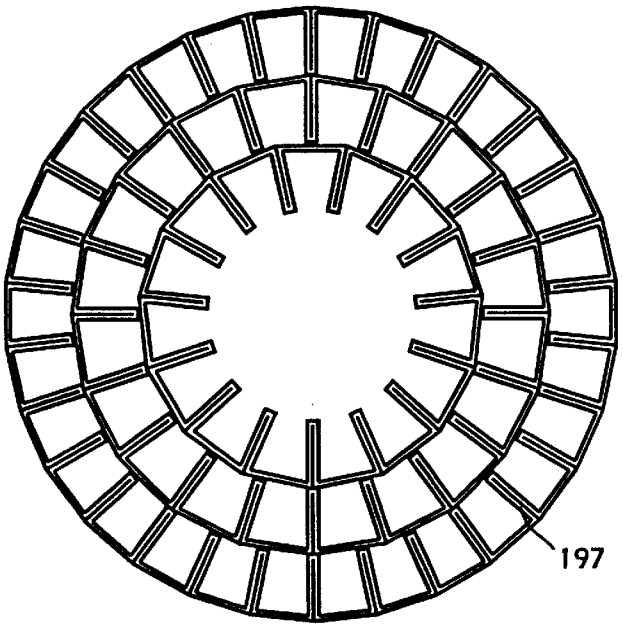
FIG. 29*c* illustrates, in a view along the lens axis, its construction from bands according to FIG. 29*b,*

The band material obtained in this way having protrusions or flanges 197 is then placed along a circular or approximately circular path having the intended radius. The band can either be placed on one of the thicker, more stable and bevelled annular bands described above or on an earlier inserted similar band shaped like a comb, see FIG. 29*c.* The bands can in this way build the lens construction by building the lens from the inner part. and outwards in a radial direction. It is also possible to start with an outer band having a large radius and to place inside it bands shaped like a comb. Thus the lens can be constructed by placing the first band shaped like a comb on the inner side of an outermost stable circular ring, having its radial flanges 197 directed towards the lens axis. After that the next inner band is placed with the flanges 197 directed inwards like the earlier one and in engagement with the extensions or flanges of the previous outer band which have now become the radial plates 29. By the fact that the lens profile decreases when passing inwards along the radius, the earlier band has always a sufficient width for the inner band thereof, but. when a transition in the steps described above is to be performed a new stable band having a circular extension must be attached to the frame construction of the lens or the neighbouring stable bands. These stable bands are then located in radial positions which, according to the description above, provide advantages in lens structures of this kind.

The folding of the band material forming the lens structure can alternatively be substituted by one band for the circular extension on which band radial plates are mounted, which then stand perpendicularly from the band at a distance equal to one or several channel widths in the circular direction. If the distance of radial plates is two channel widths the lens can be formed by alternatingly turning the bands to face each other, two such shaped bands then forming a finished section of channels in the lens in the peripheral direction.

If these radial plates are made elastically foldable to the circular sections of the band, a possibility is obtained, like the situation in a variable lens described above, to roll up or roll out bands for making a lens structure, i.e. the lens can in this manner be made foldable or collapsible or more correctly rollable.

Figure 30A:
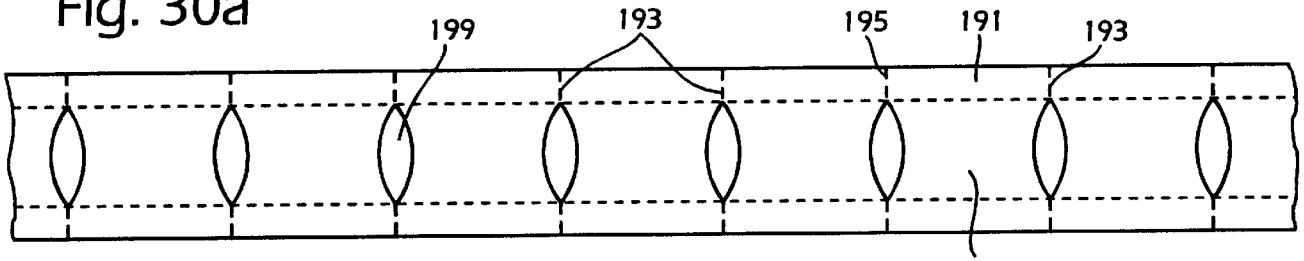
FIG. 30*a* shows in a plan view a section of a band having punched slots for folding to plates in a lens.
Figure 30B:
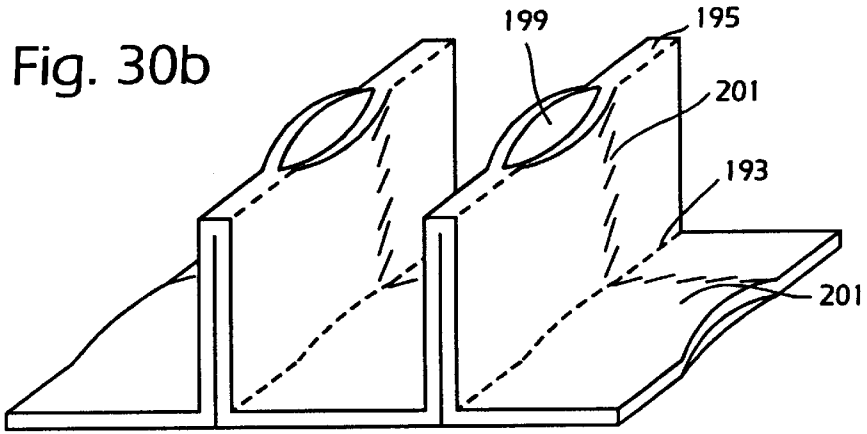
FIG. 30*b* shows in a perspective view the folded section of FIG. 30*a,*

If the band 191 in the lens constructed by this folding method is premanufactured with slots 199 located at the positions, where the foldings along the lines 193 and 195 are to take place, see FIG. 30*a,* and the slots 199 have a suitable profile, in the folding of the band 191 a shaping of the band can also be made so that bosses 201 are formed in the middle of the band 191 in its longitudinal direction. These bosses can be made before the folding, by deforming the bend 191 in a suitable way in a press. The slots 109 can, as is shown in the Figures, be shaped such as having the cross section of a double convex symmetrical optical lens. Hereby a lens antenna can be produced, where the entrance opening of the channels has a horn character, i.e. the entrance openings are for instance larger than the dimensions of the channel inside the edges. In this way the advantages described above are obtained with this embodiment having tapering channels.

Figure 31B:
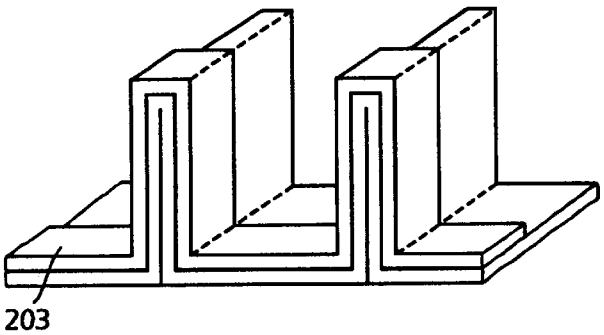
FIG. 31*b* shows in a perspective view the folded section of FIG. 31*a* for accomplishing a lens having dielectrically coated entry channels.
Figure 31A:
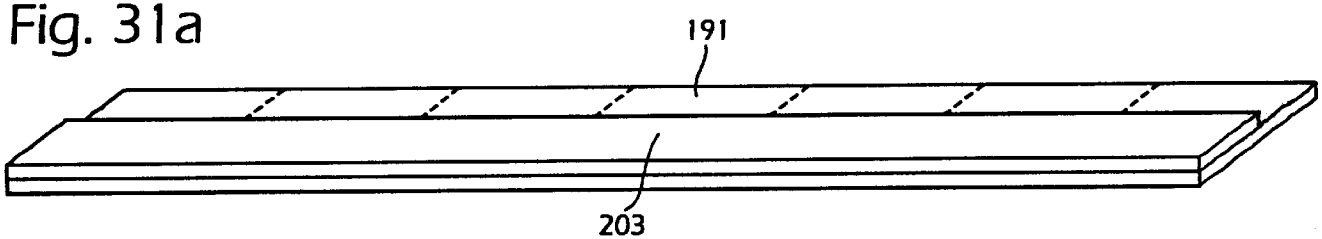
FIG. 31*a* shows in a perspective view a section of a dielectrically coated band for folding to plates in a lens.

The band 191 described above can also before possible punching and folding operations be coated by a dielectric material 203, see FIG. 31*a,* where a dielectric layer 203 is coated along one edge of the band 191. This results in an antenna having dielectrically coated channels on plates/rings in both the radial and circular directions, what thereby accomplishes the earlier described advantages of such a coating.

For a parabolic antenna there is always the problem with noise from the surroundings which enters the receiver part located in focus. When a plane electromagnetic wave is reflected against the paraboloidic surface and is refracted to a focus, it is impossible to avoid, that the reflected rays cross the incident radiation. Thereby it is possible to entirely encapsulate the receiver unit together with the antenna.

Figure 15:
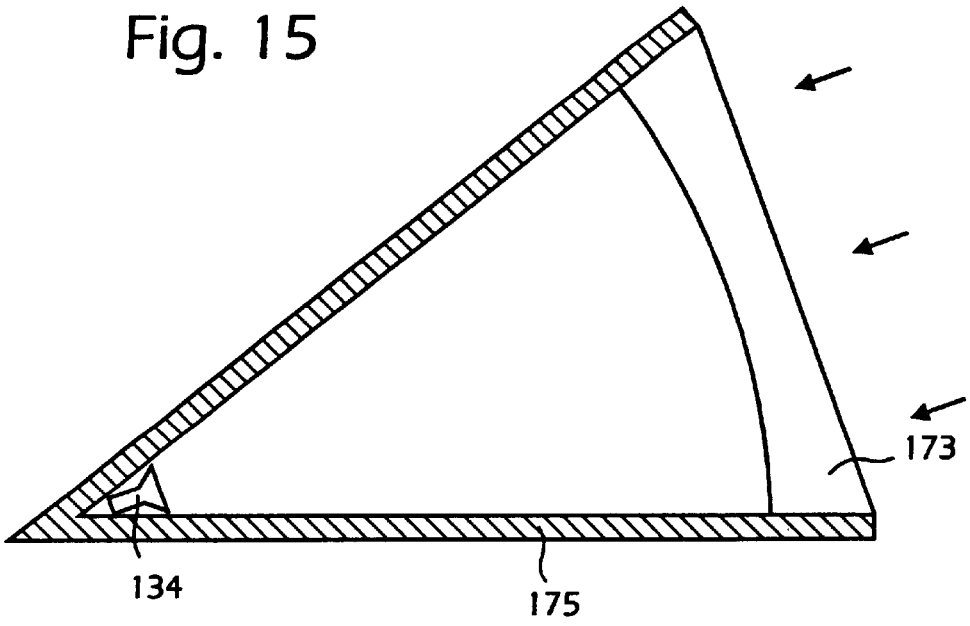
FIG. 15 shows a section of a receiver unit encapsulated together with an antenna.

However, for lens antennas, where the focus instead is located behind the lens, it is however, completely possible to encapsulate the receiver unit together with the irradiated lens, which in addition provides a theft prevention device for the costly receiver horn. The embodiment illustrated in a schematic section in FIG. 15 shows a system, where a receiver unit 134 is encapsulated together with the lens antenna, illustrated in the area 173, by an enclosure 175 of an absorbing material, which neither lets electromagnetic radiation through within the frequency range of interest for reception nor gives a reflection at the inside of the enclosure 175. Compared to an encapsulation of an electromagnetically conductive material, so that a horn is formed, it means, that the antenna will better maintain the ability to focus a wave front arriving obliquely in the lens, i.e. to focus or transmit a wave front having a propagation direction obliquely in relation to the lens axis, and at the same time the system noise is reduced substantially in relation to antennas constructed according to present standard types. It will in turn result in smaller antennas compared to the parabolic antennas of today.

The enclosure 175 can as in FIG. 15 have the shape of a circular conical surface, where the receiver unit 134 is located inside the apex area of the conical surface and the lens 173 is located at the opening of the conical surface.

For the rollable lens having plates circularly or in spiral shapes along the lens axis the encapsulation can be made as in FIG. 15, with an enclosure extending around the whole outermost radius of the lens in a cone from the lens to the focus device, where the enclosure is divided for a rolling-up operation by means of a division of the enclosure along the conical surface from the lens to the end of the enclosure at the focus device. The division can for example be overlapping so that the enclosure is totally covered also in a maximally rolled out position but also in adjustments of the focus of the lens according to the described method. When the lens is rolled up, the enclosure is rolled up. This can also be viewed as a rollable horn, and the difference compared to the description above is that the walls in this case are made of an elastic material influencing and conducting the electromagnetic radiation into the focus also along the wall of the horn.

Figure 16:
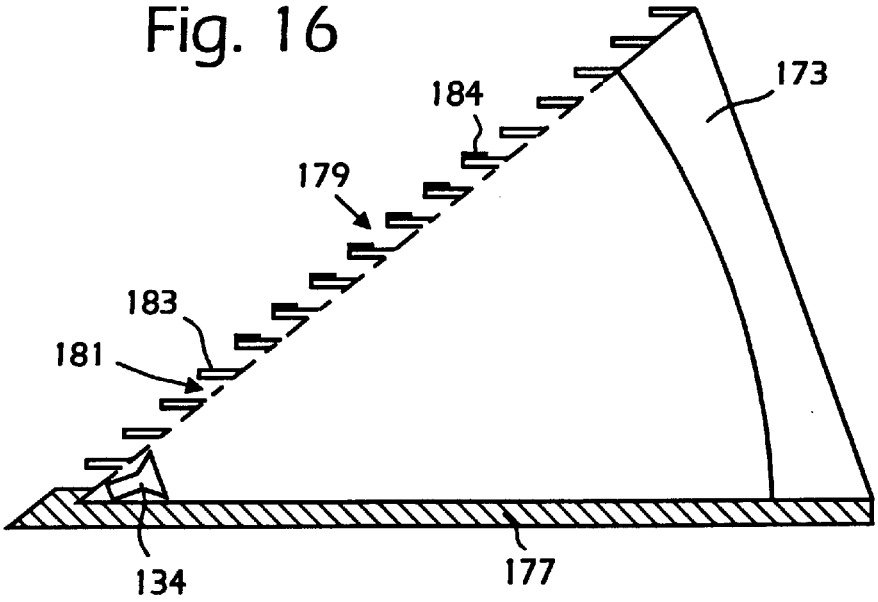
FIG. 16 shows a section of a receiver unit encapsulated together with an antenna, where the encapsulation enables perviousness to wind.

In order to accomplish a system having an encapsulated antenna and a receiver unit which at the same time is pervious to wind, the encapsulation schematically illustrated in FIG. 16 can be used. The enclosure has here the same shape as the enclosure 175 in FIG. 15 and comprises partly portions 177 of the same absorbing material, partly portions 179 of metal having slots 181 between flanges 183 attached in a manner not shown. The slotted portions 179 provide perviousness to the wind and shield the electromagnetic noise outside the edge of the lens 173 in the same way as a microwave horn. At the same time the slotted part 179 of the enclosure filters reflections which enter through the lens from other directions than the intended radiation, by the fact that the lenses 183 are made with a greater height than half the wavelength of the lowest possible noise frequency which can influence the system. The slots 181 are made with a width to provide the lowest possible reflection by an impedance match. The flanges 183 are oriented in an angle, such that radiation inwards through the lens 173 is not reflected to the focus and their lengths are adapted for shielding noise arriving from locations outside the antenna 173 and from the side of the enclosure 177, 179. Noise arriving from the opposite direction in relation to the outgoing noise from the slots and from a place straight behind the focus, can be reduced by for instance flanges coated with a dielectric material, such as indicated with strips at 184.

What is claimed is:

1. A waveguide lens for electromagnetic radiation and having an axis, the waveguide lens refracting electromagnetic radiation passing through the waveguide lens from a first side of the waveguide lens to a second side of the waveguide lens opposite the first side, so that the waveguide lens focuses an electromagnetic wave incoming to the first side to a focus located on the second side or produces a substantially plane wave issued at the first side from a substantially spherical electromagnetic wave transmitted from a source located at the focus on the second side, the waveguide lens comprising at least two rings of a material interacting with the electromagnetic radiation, the at least two rings having a substantially rotationally symmetric shape in relation to the axis, each ring extending substantially in a direction of the axis and being separate from each other, arranged with a radial interspace as taken in a direction outwards from the axis, the at least two rings being arranged to form waveguiding channels performing the refracting of the waveguide lens.

2. The waveguide lens of claim 1, wherein the at least two rings comprise a number of wires which are located at a distance from each other and have a metallic surface.

3. The waveguide lens of claim 1, wherein the at least two rings are made of a perforated material.

4. The waveguide lens of claim 1, wherein the at least two rings are arranged to have an adjustable shape to be adjusted to at least two positions, whereby a refraction to or from the focus can be adjusted for at least two different frequencies of the electromagnetic radiation.

5. The waveguide lens of claim 1, wherein the at least two rings are arranged to be rolled up to collapse the waveguide lens and to be rolled out to unfold the waveguide lens to a position thereof for refracting to or from the focus.

6. The waveguide lens of claim 1, wherein the at least two rings are electrically conducting or have an electrically conductive surface coating for forming a waveguide lens of a metal lens character.

7. The waveguide lens of claim 6, further comprising at least one ring of a dielectric material, the at least one ring of a dielectric material having a substantially rotationally symmetric shape in relation to the axis and having a profile corresponding to portions of a lens profile, whereby the electromagnetic waves are refracted to and from the focus by both the at least two rings being electrically conducting or having an electrically conductive surface coating and by the at least one ring of a dielectric material.

8. The waveguide lens of claim 1, wherein the at least two rings each comprise a band, which has an electrically conductive surface, has a uniform thickness and width and has substantially the shape of the curved surface of a straight circular cylinder.

9. The waveguide lens of claim 1, wherein the at least two rings are made of dielectric materials, have a uniform thickness and width and has substantially the shape of an annular circular straight cylinder ring.

10. The waveguide lens of claim 1, further comprising at least two substantially flat plates located in axial planes extending through the axis, the at least two flat plates having a profile in a direction of the axis, such that a radial component of the electromagnetic radiation is refracted to and from the focus.

11. The waveguide lens of claim 10, wherein the at least two plates together with the at least two rings form wave guiding channels having four side surfaces and the at least two plates form distance material for retaining the at least two rings in intended positions.

12. The waveguide lens of claim 1, wherein edge portions of the at least two rings are bevelled or are made tapering to minimize reflection.

13. The waveguide lens of claim 10, wherein edge portions of the at least two plates are bevelled or are made tapering to minimize reflection.

14. The waveguide lens of claim 1, wherein the at least two rings comprise bevelled edge portions, the bevelled edge portions being made in such a way, that radiation impedance for each wave guiding channel is maximally adapted to free space.

15. The waveguide lens of claim 10, wherein the at least two rings and the at least two plates comprise bevelled edge portions, the bevelled edge portions being made in such a way, that radiation impedance for each wave guiding channel is maximally adapted to free space.

16. The waveguide lens of claim 1, wherein the wave gilding channels have surfaces which at least over significant portions deviate from a position parallel to the axis and form an angle thereto to increase directivity and suppression of side lobes for each wave guiding channel.

17. The waveguide lens of claim 1 comprising a stepwise change of the width of the at least two rings, when passing radially outwards from the axis, to reduce a total width of the waveguide lens and to refract a later wavefront of the electromagnetic radiation into phase with an earlier wavefront.

18. The waveguide lens of claim 1, further comprising an enclosure of a shielding and absorbing material, the enclosure having a shape to encapsulate or enclose paths of the electromagnetic radiation from the lens to the focus and inversely, whereby electromagnetic radiation arriving in directions different from a direction of the axis to be refracted towards the focus is eliminated.

19. The waveguide lens of claim 18, wherein the material of the enclosure is pervious to wind.

20. The waveguide lens of claim 1, wherein the at least two rings comprise bands of a dielectric material coated with electrically conducting material, the electrically conducting material is one of perforated and wire-shaped.

21. The waveguide lens of claim 10, wherein the at least two plates comprise bands of a dielectric material coated with electrically conducting material, the electrically conducting material is one of perforated and wire-shaped.

22. A waveguide lens for electromagnetic radiation comprised of a portion of a primary lens which primary lens has an axis and an outer substantially circular outline as taken in a direction of the axis, the waveguide lens and the primary waveguide lens refracting electromagnetic radiation passing through the lens from a first side of the lens to a second side of the lens opposite the first side, so that the lens focuses an electromagnetic wave incoming to the first side to a focus located on the second side or produces a substantially plane wave issued at the first side from a substantially spherical electromagnetic wave transmitted from a source located at the focus on the second side, the primary waveguide lens comprising at least two rings of a material interacting with the electromagnetic radiation, the at least two rings having a substantially rotationally symmetric shape in relation to the axis and being separate from each other, each ring extending substantially in a direction of the axis, the at least two rings being arranged to form waveguiding channels performing the refracting of the primary waveguide lens.

23. A waveguide lens for electromagnetic radiation and having an axis, the waveguide lens refracting electromagnetic radiation passing through the waveguide lens from a first side of the waveguide lens to a second side of the waveguide lens opposite the first side, so that the waveguide lens focuses an electromagnetic wave incoming to the first side to a focus located on the second side or produces a substantially plane wave issued at the first side from a substantially spherical electromagnetic wave transmitted from a source located at the focus on the second side, the waveguide lens comprising at least one arm having a spiral shape, the at least one arm being made of a material interacting with the electromagnetic radiation and extending from the axis, the at least one arm being arranged to form waveguiding channels performing the refracting of the waveguide lens.

24. The waveguide lens of claim 23 having at least two arms, wherein the at least two arms are symmetrically arranged about the axis.

25. The waveguide lens of claim 23, further comprising at least two substantially flat plates located in axial planes extending through the axis, the at least two flat plates having a profile in a direction of the axis, such that a radial component of the electromagnetic radiation is refracted to and from the focus.

26. The waveguide lens of claim 23, wherein a stepwise change of the width of the least two arms is arranged when passing radially outwards from the axis to reduce a total width of the waveguide lens and to refract a later wave front of the electromagnetic radiation into phase with an earlier wavefront.

27. A waveguide lens for electromagnetic radiation and having an axis, the waveguide lens refracting electromagnetic radiation passing through the waveguide lens from a first side of the waveguide lens to a second side of the waveguide lens opposite the first side, so that the waveguide lens focuses an electromagnetic wave incoming to the first side to a focus located on the second side or produces a substantially plane wave issued at the first side from a substantially spherical electromagnetic wave transmitted from a source located at the focus on the second side, the waveguide lens comprising at least two rings of a material interacting with the electromagnetic radiation, the at least two rings having a substantially rotationally symmetric shape in relation to the axis, each ring extending substantially in a direction of the axis and being separate from each other, arranged with a radial interspace as taken in a direction outwards from the axis, the at least two rings being arranged to form waveguiding channels performing the refracting of the waveguide lens, wherein the at least two rings are arranged to have an adjustable shape to be adjusted to at least two positions, whereby a refraction to or from the focus can be adjusted for at least two different frequencies of the electromagnetic radiation.

28. A waveguide lens for electromagnetic radiation and having an axis, the waveguide lens refracting electromagnetic radiation passing through the waveguide lens from a first side of the waveguide lens to a second side of the waveguide lens opposite the first side, so that the waveguide lens focuses an electromagnetic wave incoming to the first side to a focus located on the second side or produces a substantially plane wave issued at the first side from a substantially spherical electromagnetic wave transmitted from a source located at the focus on the second side, the waveguide lens comprising at least two rings of a material interacting with the electromagnetic radiation, the at least two rings having a substantially rotationally symmetric shape in relation to the axis, each ring extending substantially in a direction of the axis and being separate from each other, arranged with a radial interspace as taken in a direction outwards from the axis, the at least two rings being arranged to form waveguiding channels performing the refracting of the waveguide lens, and an enclosure of a shielding and absorbing material, the enclosure having a shape to encapsulate or enclose paths of the electromagnetic radiation from the lens to the focus and inversely, whereby electromagnetic radiation arriving in directions different from a direction of the axis to be refracted towards the focus is eliminated.

29. A waveguide lens for electromagnetic radiation and having an axis, the waveguide lens refracting electromagnetic radiation passing through the waveguide lens from a first side of the waveguide lens to a second side of the waveguide lens opposite the first side, so that the waveguide lens focuses an electromagnetic wave incoming to the first side to a focus located on the second side or produces a substantially plane wave issued at the first side from a substantially spherical electromagnetic wave transmitted from a source located at the focus on the second side, the waveguide lens comprising at least two rings of a material interacting with the electromagnetic radiation, the at least two rings having a substantially rotationally symmetric shape in relation to the axis, each ring extending substantially in a direction of the axis and being separate from each other, arranged with a radial interspace as taken in a direction outwards from the axis, the at least two rings being arranged to form waveguiding channels performing the refracting of the waveguide lens, and an enclosure of a shielding and absorbing material, the enclosure having a shape to encapsulate or enclose paths of the electromagnetic radiation from the lens to the focus and inversely, whereby electromagnetic radiation arriving in directions different from a direction of the axis to be refracted towards the focus is eliminated, wherein the material of the enclosure is pervious to wind.

* * * * *